US005784936A

United States Patent [19]

King

[11] Patent Number: 5,784,936

[45] Date of Patent: Jul. 28, 1998

[54] SLICE STACKER FOR A SLICING MACHINE

[75] Inventor: Robert W. King, Worthington, Ohio

[73] Assignee: J. E. Grote Company, Inc., Blacklick, Ohio

[21] Appl. No.: 654,184

[22] Filed: May 28, 1996

Related U.S. Application Data

[63] Continuation-in-part of Ser. No. 604,760, Feb. 23, 1996, abandoned.

[51] Int. Cl.[6] ..... B26D 7/32

[52] U.S. Cl. ..... 83/145; 83/437.1; 83/932; 83/86; 99/537

[58] Field of Search ..... 83/86, 81, 82, 83/87, 91, 93, 101, 111, 112, 145, 129, 130, 136, 155, 150, 160, 435.11, 435.21, 437.1, 932; 425/311, 315; 99/537, 589

[56] References Cited

U.S. PATENT DOCUMENTS

| | | | |
|---|---|---|---|
| 2,008,090 | 7/1935 | Walter . | |
| 2,073,082 | 3/1937 | Walter | 83/91 X |
| 2,227,683 | 1/1941 | Walter . | |
| 2,834,388 | 5/1958 | Meyer | 83/91 X |
| 2,989,104 | 6/1961 | Good | 83/87 X |
| 3,033,067 | 5/1962 | Thumim | 83/81 X |
| 3,457,814 | 7/1969 | Muchnick . | |
| 3,760,715 | 9/1973 | Grote et al. . | |
| 3,848,491 | 11/1974 | Flesch | 83/86 X |
| 4,436,012 | 3/1984 | Hochanadel . | |
| 4,474,093 | 10/1984 | Neubuser et al. . | |
| 4,543,864 | 10/1985 | Hochanadel et al. . | |
| 4,712,458 | 12/1987 | Mally | 83/86 |
| 5,107,731 | 4/1992 | Kent | 83/91 |
| 5,410,929 | 5/1995 | Wallace | 83/160 |

FOREIGN PATENT DOCUMENTS

| | | | |
|---|---|---|---|
| 661484 | 5/1938 | Germany | 83/86 |
| 1557033 | 1/1969 | Germany . | |
| 512852 | 9/1939 | United Kingdom | 83/86 |

*Primary Examiner*—Eugenia Jones
*Assistant Examiner*—Charles Goodman
*Attorney, Agent, or Firm*—Jason H. Foster; Kremblas, Foster, Millard & Pollick

[57] ABSTRACT

An improved slice stacking device for a food slicing machine. The machine has a reciprocating carriage to which an elongated food product workpiece is mounted. The workpiece reciprocates through a cutting blade, forming a slice in each cycle. A stacking bed has a textured surface for unidirectional sliding resistance and is mounted to the carriage beneath the blade. Multiple curved fingers are rigidly mounted below an outfeed table and extend downwardly to contact, or be closely spaced from, the upper surface of the stacking bed during a portion of the reciprocation cycle. A slice removed from the workpiece lands on the stacking bed and passes beneath the fingers. During the rearward motion of the stacking bed, the slice is wiped from the stacking bed by the wiper fingers. Another embodiment includes a rake having downwardly extending tines positioned above the stacking bed. The tines extend downwardly into grooves between ridges on the stacking bed.

20 Claims, 24 Drawing Sheets

SLICE STACKER FOR A SLICING MACHINE

This application is a continuation-in-part application of Ser. No. 08/604,760, filed on Feb. 23, 1996, now abandoned.

TECHNICAL FIELD

This invention relates to the field of machines used for cutting slices from a workpiece. The invention more specifically relates to food slicing machines which cut thin slices from an elongated food product workpiece by reciprocating the workpiece through a cutting blade and stack the slices.

BACKGROUND ART

Slicing machines for slicing elongated food products generally operate under one of two principles. Either the food is held generally stationary and sliced with a moving cutter, or the food is moved through a stationary cutter. An example of the former is shown in U.S. Pat. No. 2,008,090 to Walter in which a rotating blade severs slices from a gravity fed food product, dropping the slices onto a conveyer. In the Walter machine, the cutting blade moves and the elongated food product stays generally stationary (except for longitudinal feeding of the food product downwardly once a slice is removed).

Examples of the latter type of machine are shown in U.S. Pat. No. 3,760,715 to Grote et al., illustrated in FIGS. 1–3, and U.S. Pat. No. 4,436,012 to Hochanadel, illustrated in FIG. 18, both of which are incorporated by reference.

With any slicing machine, it is desirable to be able to position the slices in a precise location after they are cut. This precise location of the slices enables the user to position multiple slices in an arrangement desirable for packaging or display. For example, it is often desirable to stack multiple circular slices in a cylindrical stack and later place the stack in a cylindrical package. In this case, each slice is preferably positioned exactly over the previous, lower slice so that the finished stack forms a cylinder. Alternatively, it is often desirable to "shingle" a plurality of slices which requires a precise offset of each slice relative to the slice below it. Shingling involves placing a slice on top of the previously formed, lower slice, but with the upper slice displaced from the lower slice by a small, predetermined amount. When this is performed with multiple slices, the stack has a pleasing appearance with the top slice showing in its entirety, and each underlying slice showing a small crescent-shaped portion of its upper surface.

Devices exist for stacking slices during the cutting process. Walter, in U.S. Pat. No. 2,008,090, discloses a pair of longitudinally displaced arms which extend just above the upper surface of a multi-strand conveyer. As bacon slices are formed by the rotating cutting blade, they fall onto the slowly advancing arm. Once the arm reaches an extreme distal point, it is displaced downwardly, below the upper surface of the multi-strand conveyor. The stack of slices then rests on the multi-strand conveyor which takes the stack away. The second arm, meanwhile, is displaced into position to receive slices once the first arm has moved out of the way. The Walter apparatus is rather complex, involving multiple cams, bearings, hinge points and gears, all of which pose a health problem since they can hold bacteria and provide a wear point from which particles can be released into the food processing environment. The moving parts increase the need for maintenance and consume power from the drive means.

Additionally, since Walter uses a stationary workpiece, this device does not require the arms receiving the slices to move at the same rate as the workpiece. However, in the Grote '715 and the Hochanadel '012 types of machines, it is desirable to horizontally move the surface on which the falling slice first lands at the same speed as the falling slice. The reason this is desirable is that this allows the falling slice to attain a predictable, horizontal position after it lands. Since a slice that is being sliced from a workpiece is released from the workpiece a portion of the slice at a time as the blade cuts through the workpiece, the slice eventually falls with the leading, earlier sliced edge lower than the trailing, later sliced edge. Since the slice does not fall with a perfectly horizontal orientation, the space between the surface onto which the slice lands and the remaining workpiece may provide enough room for the slice to rotate and become more vertically oriented. If the landing surface is stationary, the front edge of the slice could land and stop, causing the rest of the still horizontally moving slice to curl over the front of the slice. But if the landing surface moves at the same speed as the slice, the front edge will not stop when it contacts the surface first; instead the slice will land as if it had no horizontal component of motion and landed on a stationary surface.

In U.S. Pat. No. 2,227,683, Walter discloses another food stacking apparatus, which also involves multiple moving parts and complex gearing and slice conveying devices.

Muchnick, in U.S. Pat. No. 3,457,814, discloses a strip severing and stacking device which is used to slice strips from a long roll of sheet. Muchnick does not cut slices from an elongated food workpiece, but teaches a stacking device.

U.S. Pat. No. 4,474,093 to Neubuser et al. shows a paper sheet stacking apparatus. This patent shows a mechanism for stacking and accumulating successively supplied groups of paper sheets and is relevant primarily in the sense that it involves stacking of thin pieces.

U.S. Pat. No. 4,543,864 to Hochanadel et al. discloses a stacking conveyor positioned beneath a reciprocating carriage for receiving the slices removed from a workpiece attached in the carriage. The slices fall onto the stacking conveyor, which moves horizontally at approximately the same speed as the reciprocating carriage. Once a stack of slices has been constructed, the stacking conveyor is advanced to move the stack of slices onto a separate conveyor.

The need exists for a slice stacking apparatus which has few, or no, moving parts to produce wear particles or retain significant amounts of contaminants. By reducing or eliminating the number of moving parts, reliability of the apparatus is improved, the drive means power requirement is reduced and the cleanliness of the entire device is enhanced.

BRIEF DISCLOSURE OF INVENTION

The present invention is an improved slice stacking apparatus used in cooperation with a conventional slicing machine. The slicing machine has a reciprocatable carriage which is drivingly connected to a motor. A workpiece is retained in the carriage, and the workpiece is reciprocated along a first path. A cutter is mounted in the first path for cutting through the workpiece when the carriage moves the workpiece in a first direction. The cutting of the workpiece forms a slice which has a selected thickness.

The stacking apparatus which comprises the invention includes a stacking bed which has an upper, slice receiving surface. The slice receiving surface is reciprocatable through a second path, and the second path extends at least partially beneath the cutter. A wiper is mounted in the second path and extends downwardly toward the slice receiving surface. The wiper extends to above the slice receiving surface no more than a slice thickness during a portion of the reciprocation of the slice receiving surface. The wiper is mounted in the path through which the slice receiving surface is reciprocated for wiping the slice from the slice receiving surface.

The stacking bed is drivingly linked to, and preferably mounted to the carriage. Therefore, as the carriage is driven in the first direction, the stacking bed moves simultaneously with the carriage. During motion in the first direction, the slice is separated from the workpiece, and falls downwardly onto the slice receiving surface. The slice receiving surface reaches the extent of its motion, and after stopping moves in a second, opposite direction. It is during the motion in the second direction that the wiper removes the slice from the slice receiving surface of the stacking bed. The slice falls downwardly from the slice receiving surface onto a production conveyor.

Figure 1:
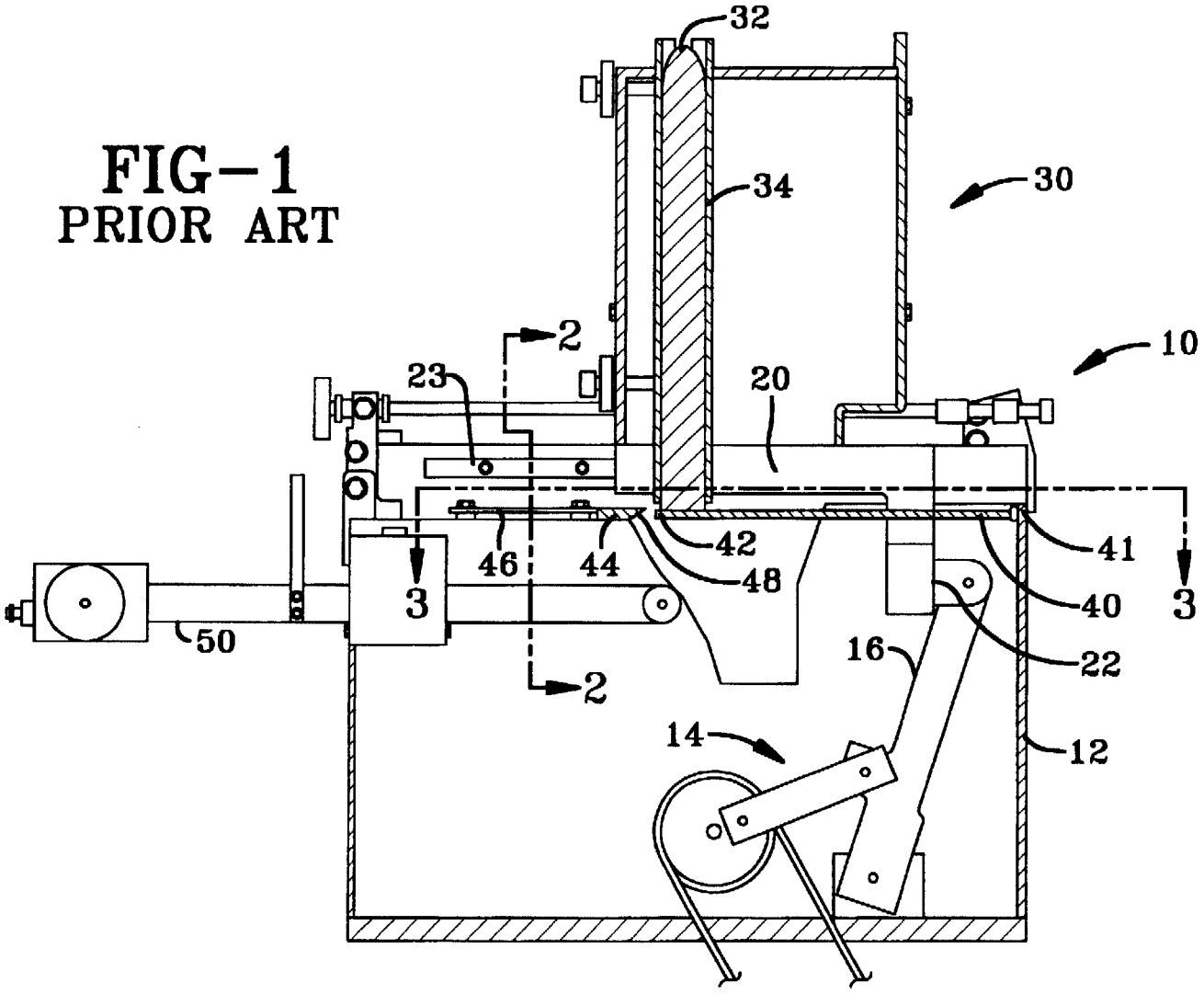
FIG-1 PRIOR ART
FIG. 1 is a side view in section illustrating the prior art slicing machine.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

Figure 2:
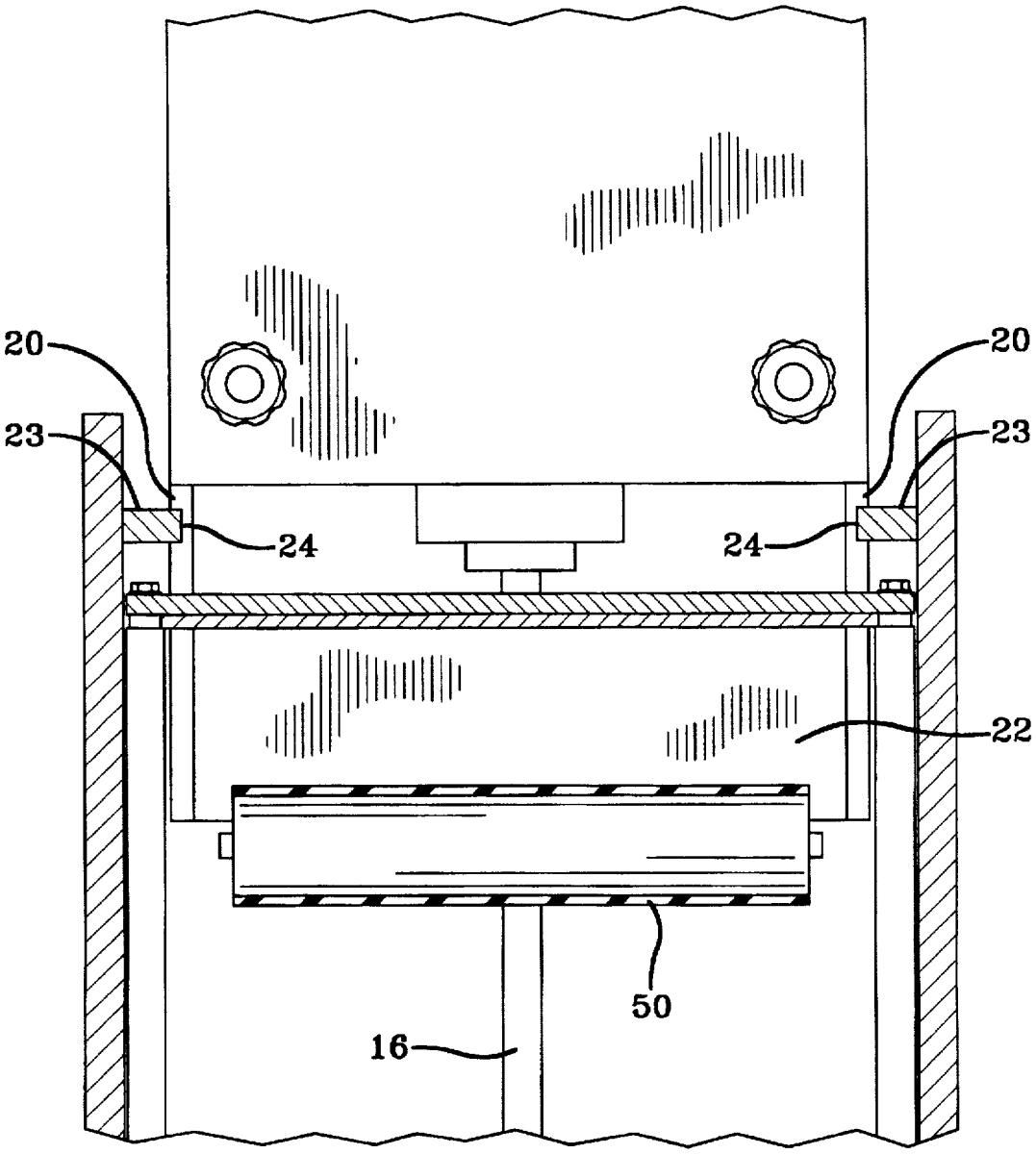
FIG-2 PRIOR ART
FIG. 2 is an end view in section through the lines 2—2 of FIG. 1.
Figure 3:
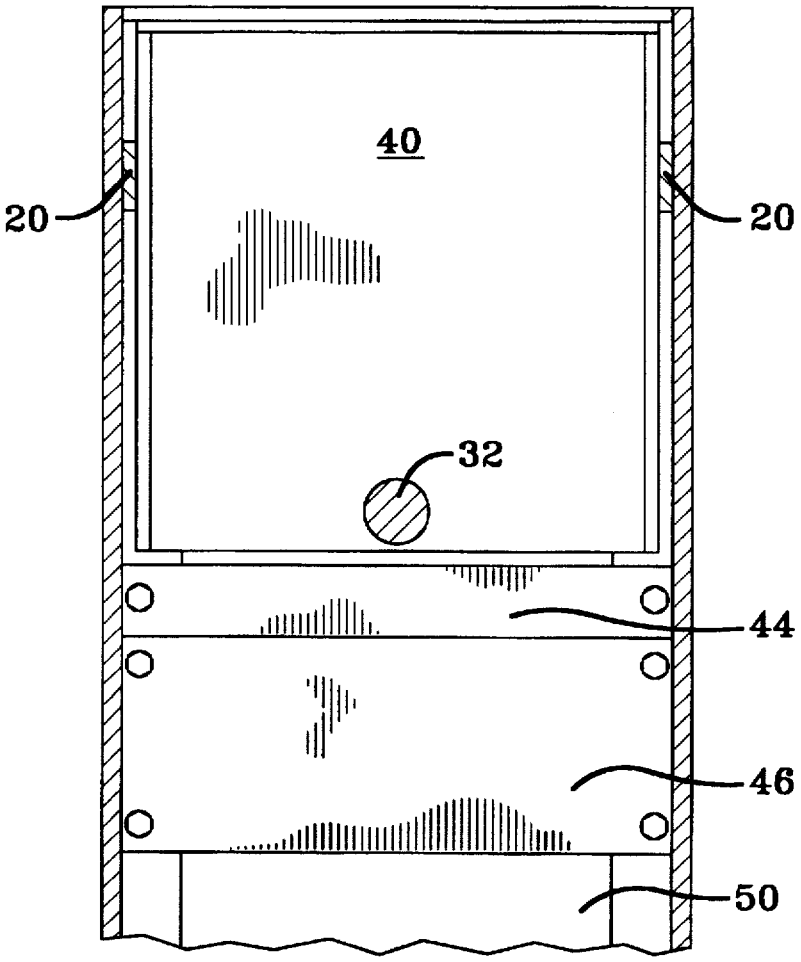
FIG-3 PRIOR ART
FIG. 3 is a top view in section through the line 3—3 of FIG. 1.

The components comprising the preferred embodiment of the present invention are mounted to existing structures of a conventional slicing machine. The machine to which the preferred embodiment mounts is described to make the operation of the invention clear. The conventional slicing machine 10, shown in FIGS. 1, 2 and 3, has a rigid housing 12 and an attached drive mechanism 14, such as an electric motor driving a chain and sprockets. A reciprocating drive bar 16 pivotably mounts to a pair of side members 20 through a beam 22 rigidly attached at the side members' 20 lower ends. The beam 22 spans the lateral gap between the side members 20, and is most easily seen in FIG. 2.

The side members 20 are reciprocated longitudinally by the drive bar 16, which is drivingly linked to the drive mechanism 14. The side members 20 are slidingly mounted to a pair of parallel guide rails 23 which permit the side members 20, and the components attached to them, to move along a defined, longitudinal path. The guide rails 23 extend laterally inwardly from rigid attachment to the housing 12 into grooves 24 formed in the outwardly facing surfaces of each side member 20.

The carriage 30 is rigidly mounted to the side members 20. An elongated food product workpiece 32 is mounted to the carriage 30 in a tube 34. The tube 34 has an inner diameter which is adjustable, allowing large variations in the size of the workpiece which can be retained by it. For example, the workpiece 32 has a diameter of approximately three inches, and to retain a larger or smaller workpiece the tube 34 is adjusted to increase or decrease its interior diameter. The workpiece 32 is maintained in position radially, but has freedom to move along its length, which is the vertical direction in FIG. 1.

The lower end of the workpiece 32 rests on a planar, infeed table 40 which is hingedly attached at its rearward end 41 to the housing 12. The infeed table 40 is vertically adjustable at its forward end 42 by a conventional vertical adjustment mechanism which is not visible in FIG. 1. A blade supporting block 44 is rigidly mounted to the housing 12 just forward of the forward end 42 of the infeed table 40 forming a gap between the infeed table 40 and the blade supporting block 44. An outfeed table 46 is rigidly mounted to the housing 12 just forward of the blade supporting block 44.

The cutting blade 48 is positioned in a groove formed in the blade supporting block 44. The blade 48 is preferably a flexible metal strip forming a closed, elliptical loop. The loop is wrapped around a drive wheel positioned on one side of the blade supporting block 44 and an idler wheel positioned on the opposite side of the block 44. The blade 48 and its drive system (which is not shown) are described in U.S. Pat. No. 4,230,007 to Grote et al. which is incorporated by reference. The blade 48 is driven to travel along the length of the groove in the blade supporting block 44 continuously during operation, like a bandsaw blade. The cutting blade 48 is held in place by the blade supporting block 44 to maintain the position of the blade 48 relative to the infeed table 40 and the outfeed table 46 to keep its sharp lateral edge along generally the same line throughout operation of the machine 10.

The components of the slicing machine 10 are shown at the beginning of a cutting cycle in FIG. 1. The drive mechanism 14 has cycled the side members 20 to their most rearward position in the reciprocation cycle. When the slicing machine 10 begins the cycle, the lower edge of the workpiece 32 rests on the top surface of the infeed table 40, and is positioned slightly rearwardly of the cutting blade 48. The upper surface of the forward end 42 of the infeed table is positioned lower than the cutting edge of the blade 48 by an amount equal to the selected slice thickness.

The side members 20 are driven forwardly by the drive mechanism 14. When the lower edge of the workpiece 32 contacts the cutting blade 48, a slice begins to be formed on the workpiece 32. As the carriage 30 advances forwardly past the cutting blade 48, the slice is completely removed from the workpiece 32, falling onto the conveyor belt 50. The workpiece 32 is displaced forwardly until its rear edge is beyond the cutting blade 48 a predetermined amount at which point the forward motion ceases and is abruptly reversed. The workpiece 32 is moved rearwardly over the top of and then beyond the cutting blade 48, at which time the force of its own weight causes the workpiece 32 to be displaced vertically downwardly onto the slightly lower infeed table 40, thus positioning it for later forward displacement and formation of another slice. The workpiece 32 is displaced rearwardly to its most extreme rearward position shown in FIG. 1, and the drive mechanism 14 ceases the rearward motion of the workpiece 32 and abruptly reverses it to repeat the above described cycle.

Figure 4:
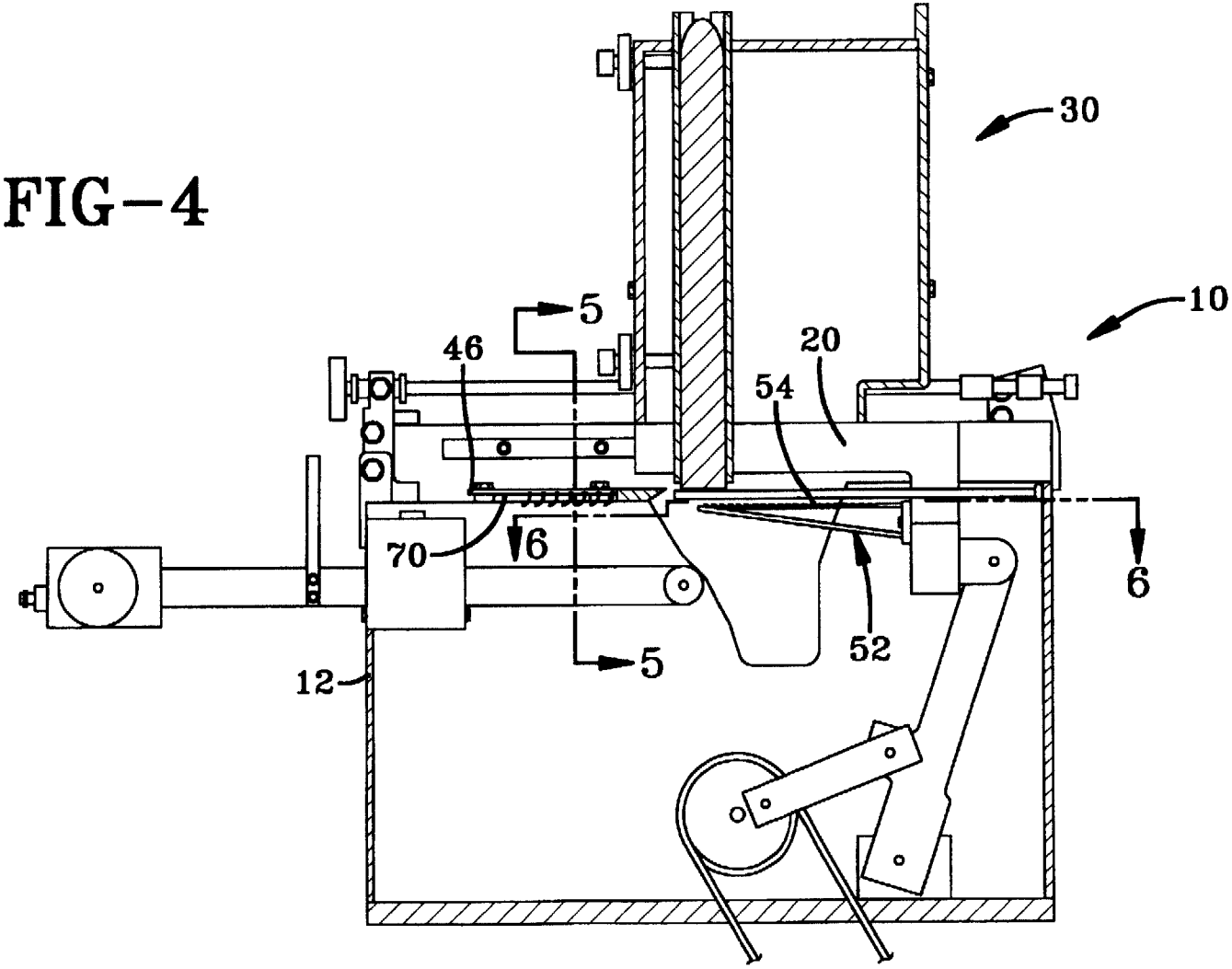
FIG. 4 is a side view in section illustrating the preferred embodiment of the present invention mounted in its operable position to a prior art slicing machine.
Figure 5:
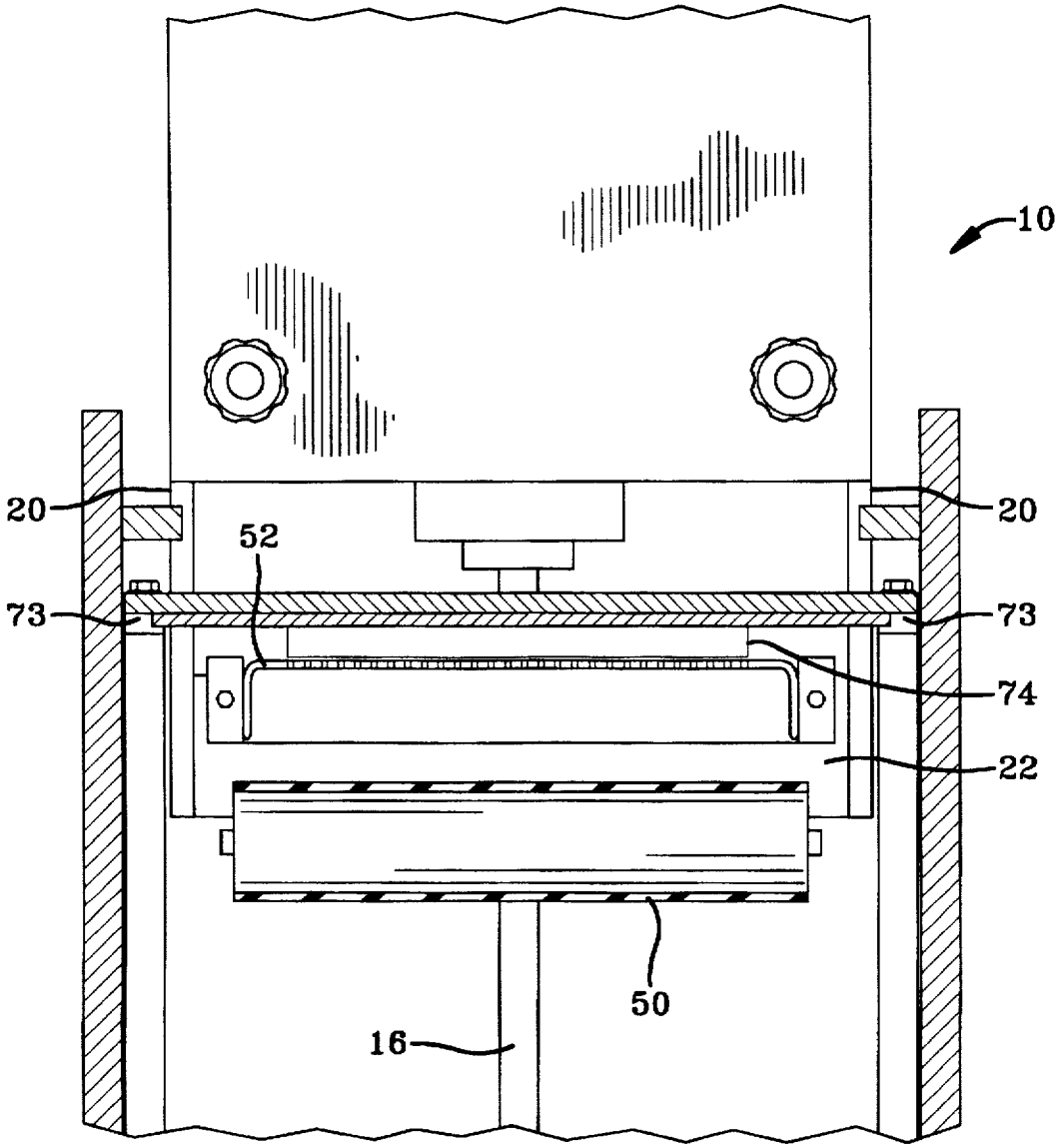
FIG. 5 is an end view in section through the line 5—5 of FIG. 4.
Figure 6:
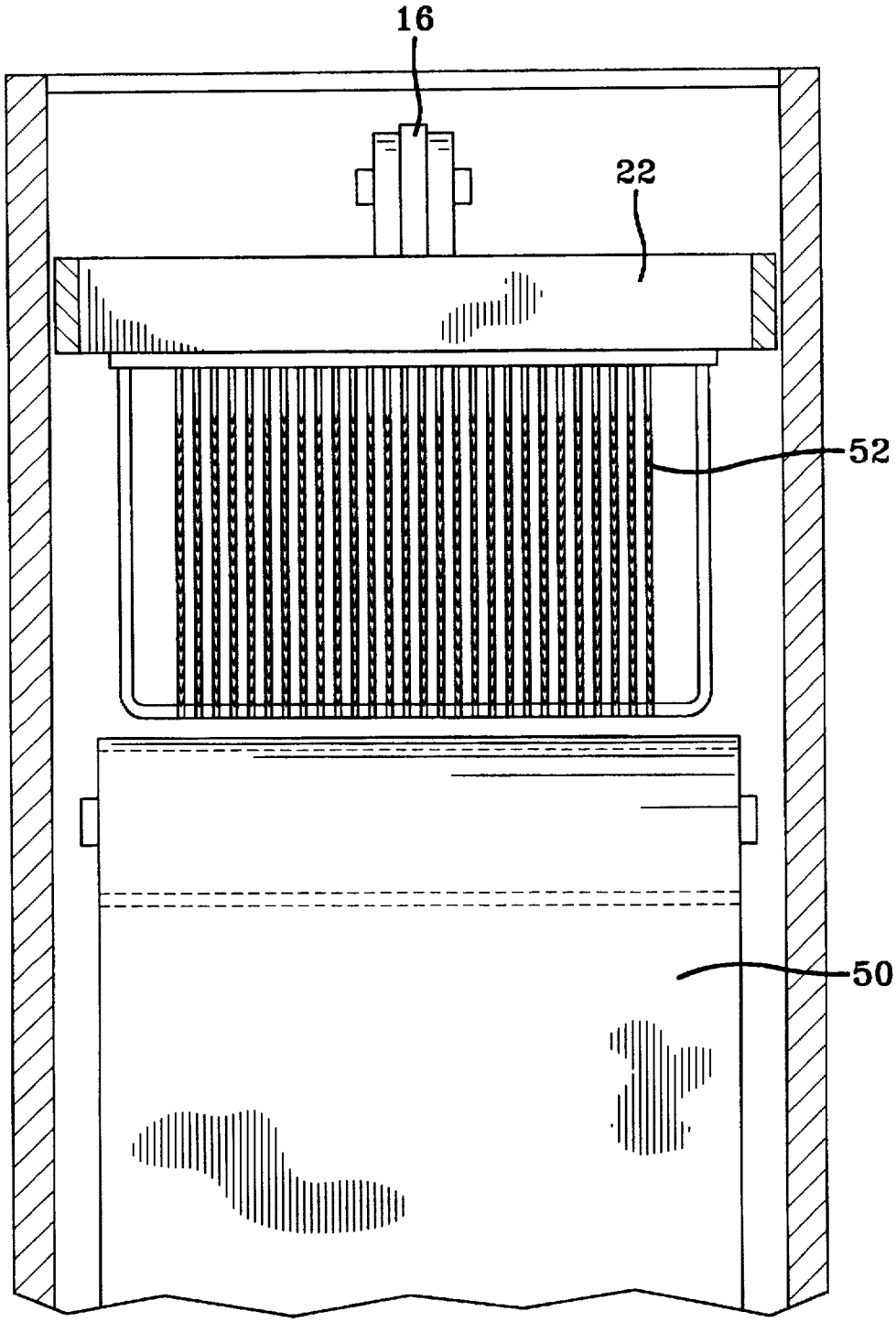
FIG. 6 is a top view in section through the line 6—6 of FIG. 4.

FIGS. 4, 5 and 6 show the conventional slicing machine 10 of FIG. 1, but with the components comprising the present invention mounted in their preferred positions. A stacking bed 52 is rigidly mounted to the beam 22 spanning between the side members 20. This is most easily seen in FIGS. 5 and 6. The stacking bed 52 is a rigid member cantilevered in a first direction from the beam 22. This first direction will be referred to as the forward direction, but "forward" does not imply a direction toward one end or side of the machine 10. The opposite, second direction will be referred to as "backward", but similarly does not mean toward a particular side or end of the machine 10.

Figure 7:
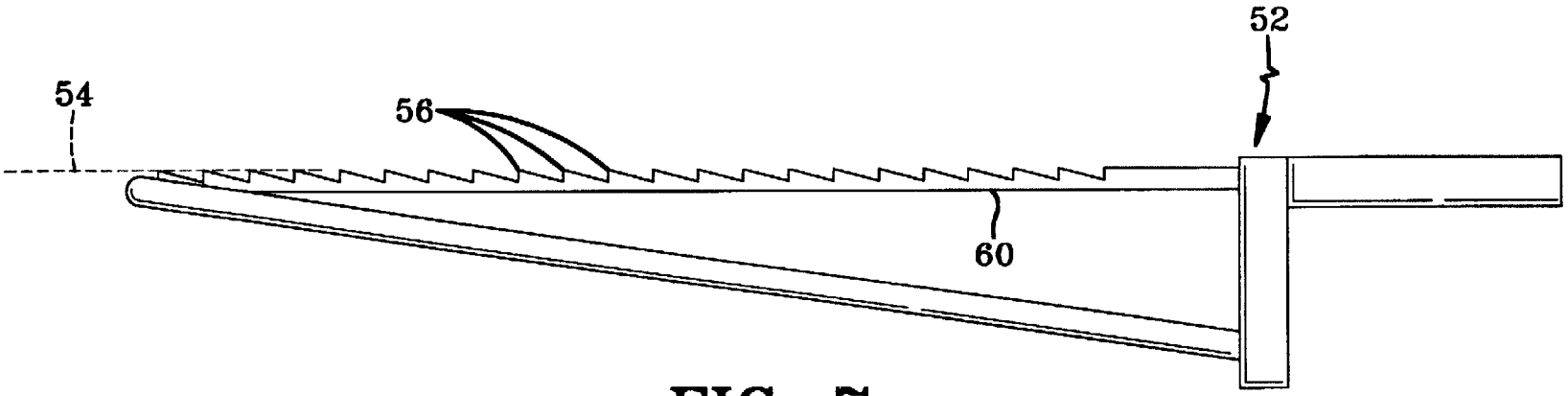
FIG. 7 is a side view illustrating the preferred stacking bed.
Figure 8:
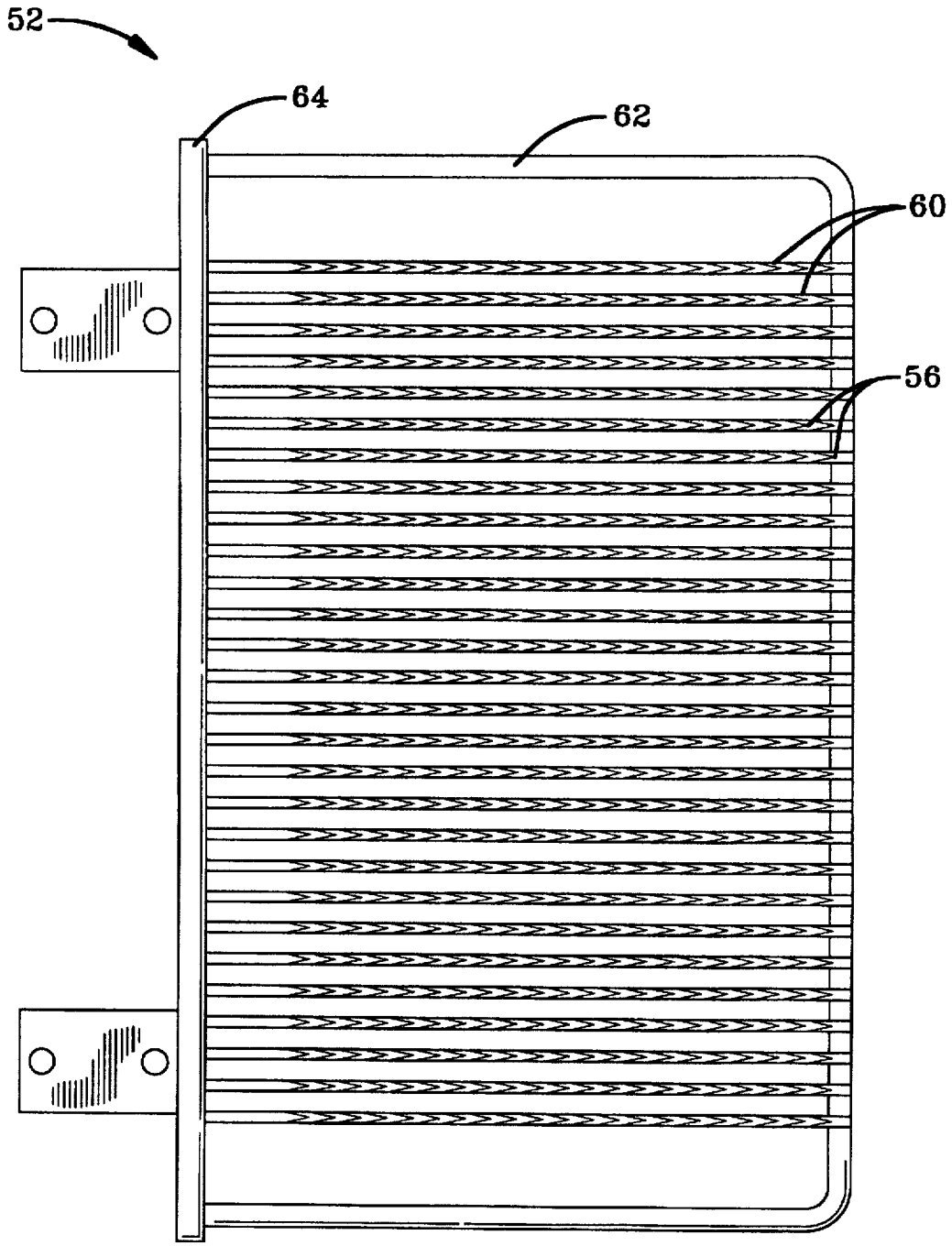
FIG. 8 is a top view illustrating the preferred stacking bed.
Figure 10:
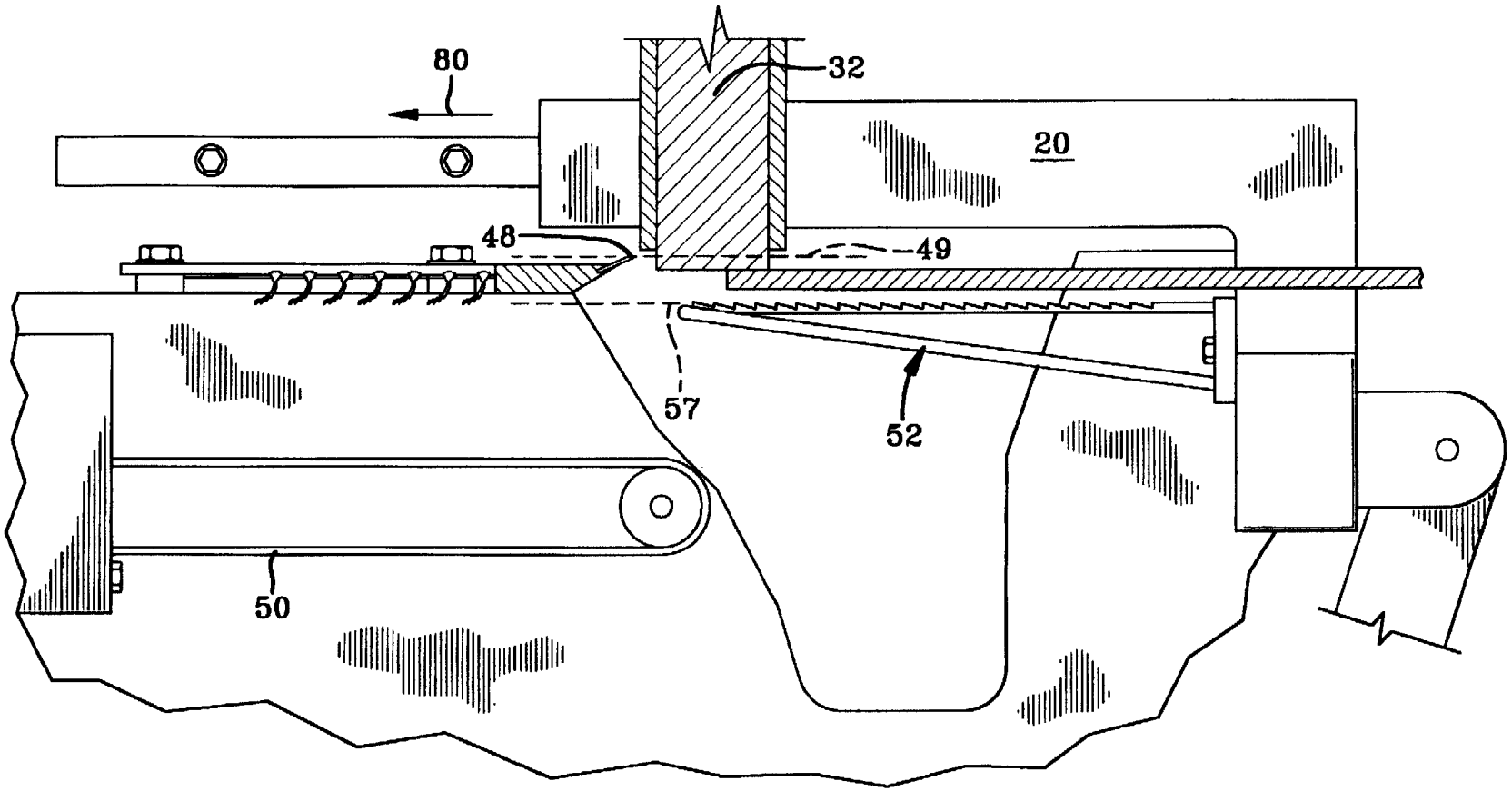
FIG. 10 is a side view in section illustrating the preferred embodiment.

Referring to FIGS. 7 and 8, slice gripping projections 56 are formed on the upper surfaces of a plurality of parallel rods 60. The projections 56 form an upper, slice receiving surface 54 extending in a plane across the tops of the slice gripping projections 56. A rigid, U-shaped support bar 62 extends frontwardly from the mounting plate 64. The rods 60 extend through passages formed in the mounting plate 64 and the support bar 62 supports the distal ends of the rods 60. The rods 60 and support bar 62 are preferably stainless steel rods having diameters of ⅛ inch and ¼ inch, respectively.

Figure 9:
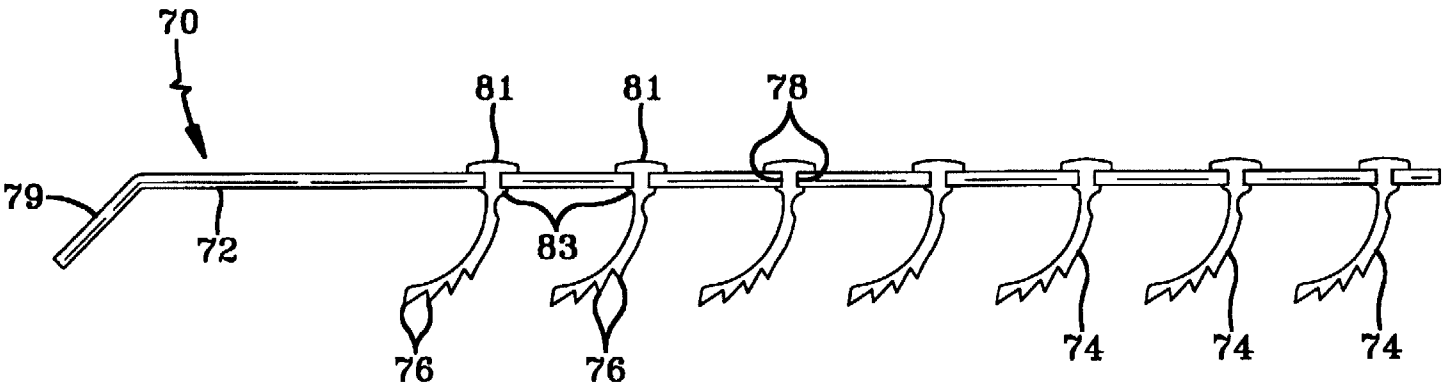
FIG. 9 is a side view illustrating the preferred wiper.

Referring to FIGS. 4, 5 and 9, a wiper 70 is mounted at the underside of the outfeed table 46. The wiper is made up of a planar, preferably stainless steel plate 72 having a plurality of slots 78 formed along its length, and a handle 79 formed at one end for insertion and removal of the wiper 70. Arcuately shaped fingers 74 attach to the plate 72 by extending the upper finger edge through the slots 78. A thin portion of the edges of the fingers 74 fits within the slots 78, and knobs 81 and shoulders 83 retain the fingers 74 in the slots 78. Each finger 74 is a long, curved, preferably extruded panel which extends downwardly from the plate 72. Each finger 74 is curved in the same direction as every other finger 74, and each has a plurality of slice gripping projections 76 formed on the downwardly and backwardly facing surface. The fingers 74 are preferably made of an elastomeric material, as is sold under the trademark SANTOPRENE, and preferably having a durometer hardness of 55 on the shore A scale. As an additional feature, each finger 74 can have a plurality of lateral slits formed across its lower edge to provide, in effect, a separation of the long finger 74 into multiple shorter fingers. This has been found to be potentially beneficial, but is not preferred.

Referring to FIG. 5, the wiper 70 is slidingly mounted at the lateral edges of the plate 72 to the slicing machine 10. Preferably, plastic blocks 73 are mounted between the outfeed table 46 and the housing 12 to function as spacers, and a groove approximately equal to the thickness of the plate 72 is formed in each block 73. The rounded knobs 81 on top of the plate 72 frictionally engage the underside of the outfeed table 46, thus keeping the wiper 70 in place during operation.

Figure 11:
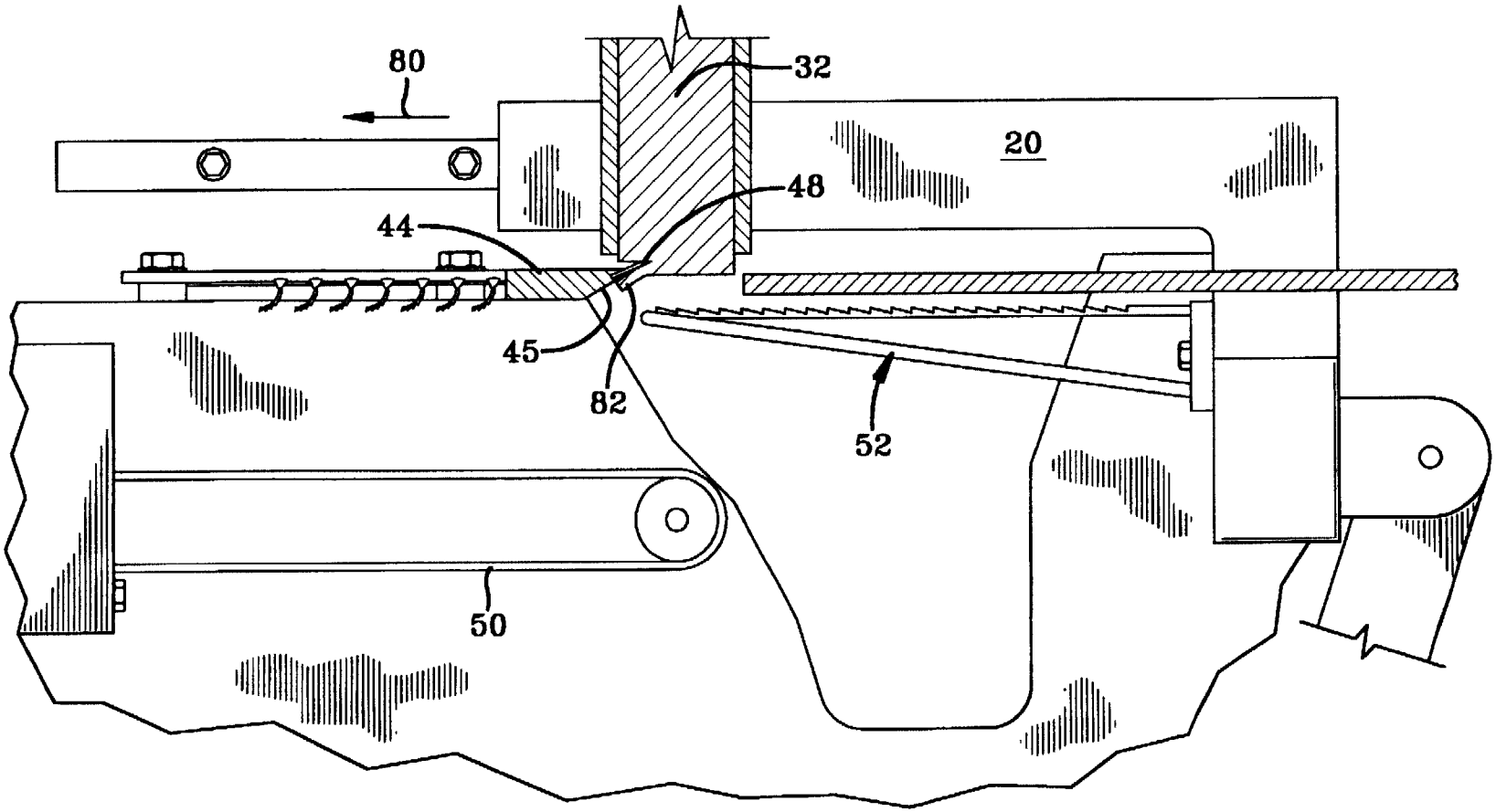
FIG. 11 is a side view in section illustrating the preferred embodiment.
Figure 12:
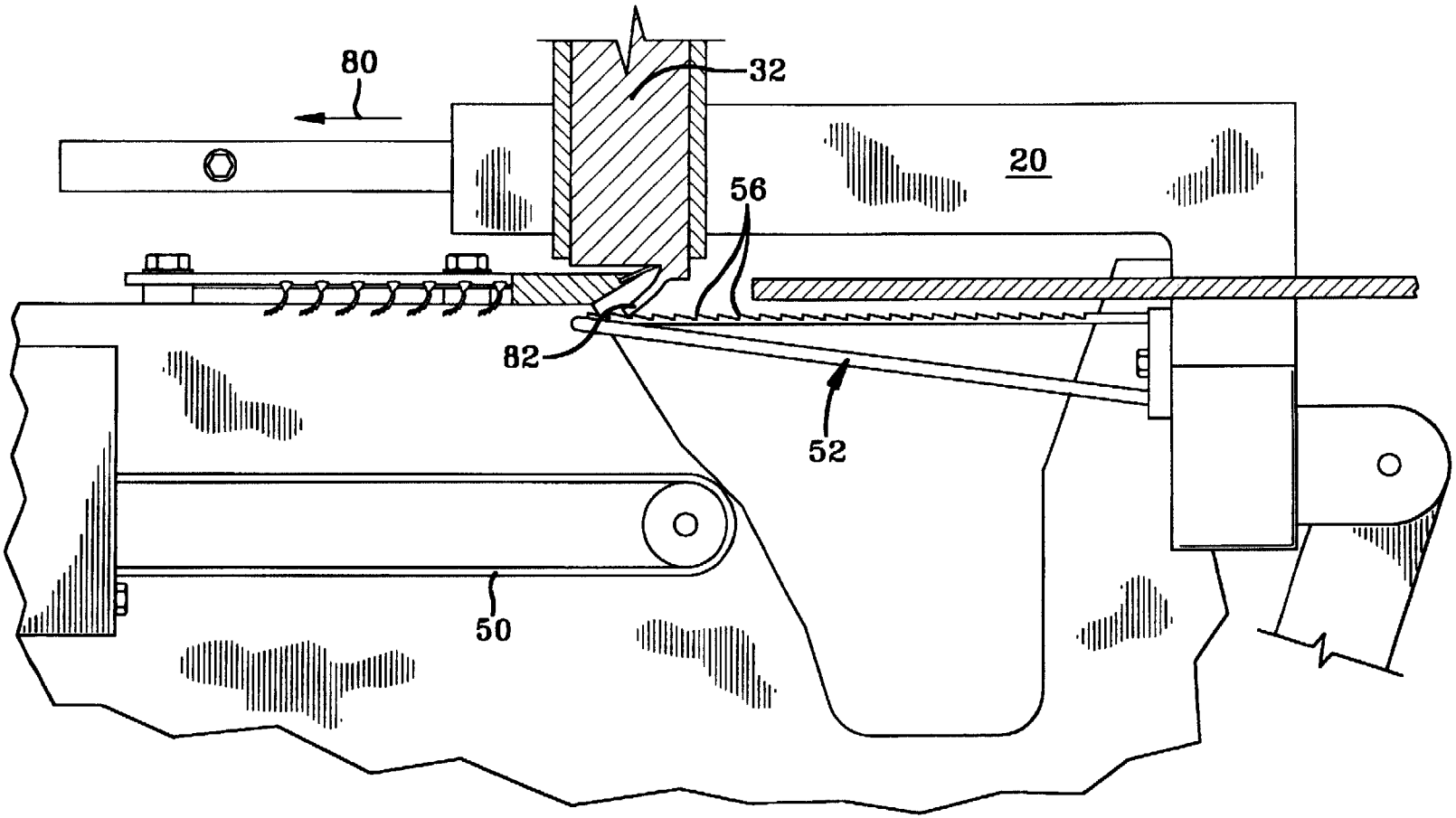
FIG. 12 is a side view in section illustrating the preferred embodiment.

The invention cooperates with the conventional slicing machine 10 in the following manner with reference to FIGS. 10–15. The side members 20, to which the workpiece 32 is mounted, begin at their most backward position as in FIG. 10. The drive mechanism forces the side members 20 in a forward direction indicated by the arrow 80 which simultaneously advances the workpiece 32 and the stacking bed 52 at the same velocity. As the workpiece 32 advances into the cutting blade 48 along the cutting path 49, a slice 82 begins to form at the bottom of the workpiece 32 as shown in FIG. 11. The inclined surface 45 of the blade supporting block 44 forces the slice 82 downwardly from the workpiece 32 toward the simultaneously advancing stacking bed 52. The cutting blade 48 continues to cut the slice 82 as the workpiece 32 advances further as shown in FIG. 12. As the slice 82 grows in length, it bends downwardly under the force of gravity, and due to the guidance of the inclined surface 45 of the blade supporting block 44, contacting and resting upon the projections 56 which are conveyed along the slice receiving path 57. Since the stacking bed 52 is so close to the workpiece 32, and moves at the same rate of speed as the workpiece 32, the slice 82 lands on the stacking bed 52 without curling over, flipping or crumpling.

Figure 13:
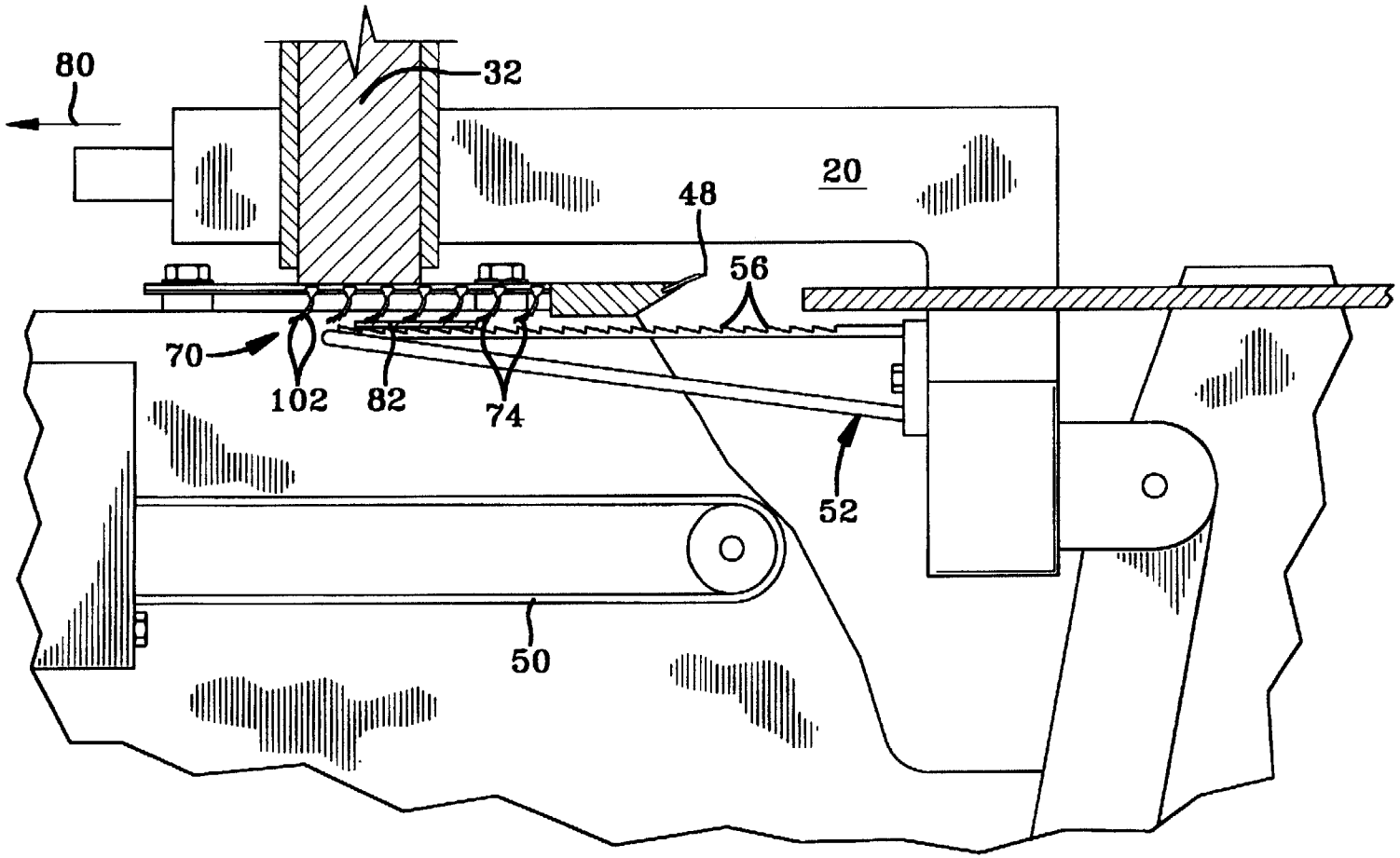
FIG. 13 is a side view in section illustrating the preferred embodiment.
Figure 14:
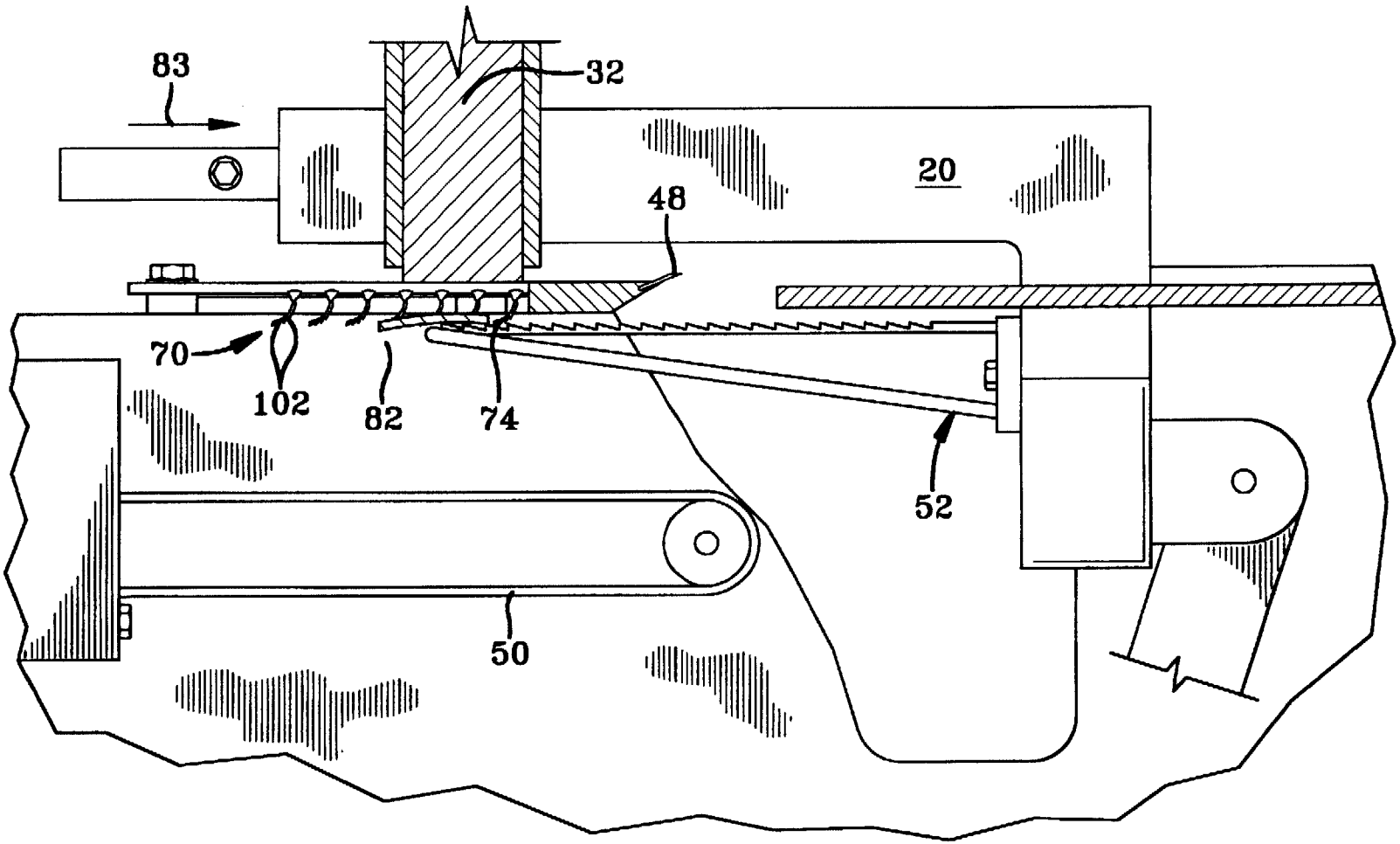
FIG. 14 is a side view in section illustrating the preferred embodiment.

FIG. 13 shows the slice 82 completely separated from the workpiece 32 and resting upon the projections 56. The workpiece 32, the slice 82 and the stacking bed 52 continue to be advanced simultaneously in a forward direction after the slice 82 is completely formed. As the slice 82, resting on the upper, slice receiving surface of the stacking bed 52, is advanced forwardly past the blade 48, it encounters one of the fingers 74 of the wiper 70. The extreme lower fingertip of each finger 74 is spaced above the slice receiving surface of the stacking bed 52 a distance which does not exceed the thickness of the slice 82. In fact, it is preferred that each fingertip contacts the projections 56 in the absence of a slice positioned between the fingers 74 and the stacking bed 52. When the forward edge of the slice 82 contacts the first finger 74, the flexible finger 74 bends forwardly and upwardly to create a gap between the finger 74 and the slice receiving surface which the slice 82 occupies and which is approximately equal to the thickness of the slice 82. A small spring force is applied downwardly to the upper surface of the slice 82 by the upwardly bent finger 74 as the slice 82 slides under it.

While the slice 82 is advanced forwardly under the finger 74 by the stacking bed 52, it maintains its position relative to the stacking bed 52. No relative motion occurs between the slice 82 and the stacking bed 52 since the resistance to backward sliding of the slice 82 on the stacking bed 52 is greater than the resistance to forward sliding against the fingers 74. This is an important feature that makes the invention function. This greater resistance to backward sliding against the stacking bed 52 than forward sliding against the fingers 74 is due to the shape of the projections 56, the fingers 74 and the slice gripping projections 76 formed on the undersides of each finger 74.

Figure 16:
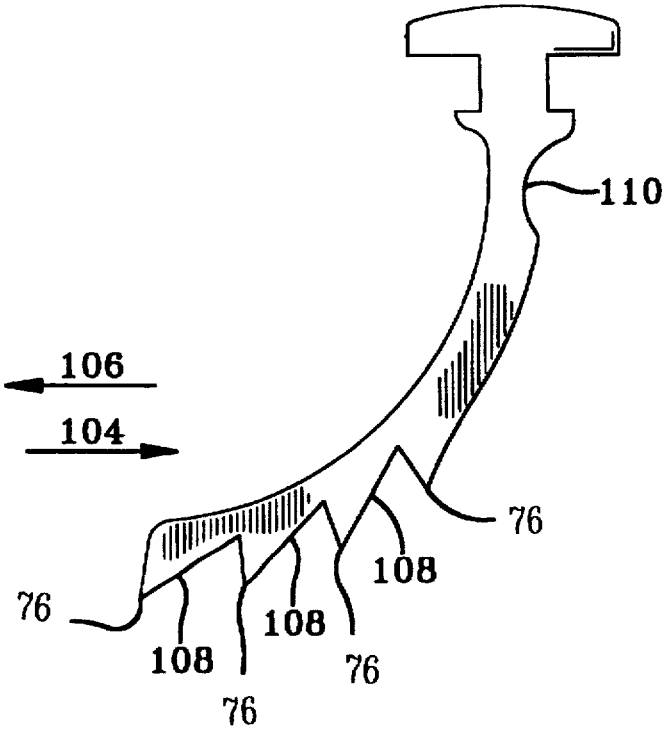
FIG. 16 is a side view illustrating the preferred wiper finger.

The preferred finger 74 is shown in FIG. 16. The finger 74 has a lower portion with slice gripping projections 76 formed in the lower edge. The slice gripping projections 76 provide substantial gripping of a slice sliding against the finger 74 in the backward direction, but produce very little resistance to a slice sliding against the finger 74 in the forward direction. The backward direction is indicated in FIG. 16 by the arrow 104 and the forward direction is indicated in FIG. 16 by the arrow 106. These are the same directions as in the other figures.

This uni-directional gripping results from the shape of the projections 76, which causes the projections 76 to have the effect of a barb. As a slice moves in the forward direction against the finger 74, the finger 74 can curve forwardly and upwardly producing a small, downward spring force. (Any spring force directed downwardly due to the fingers 74 being bent should not be so large that it tends to bunch up the slice.) Only the sloping, backwardly facing faces 108 contact the upper surface of the slice. These sloping faces 108 provide only frictional resistance, and have virtually no tendency to dig into the upper surface of the slice.

On the contrary, when the slice tends to move backwardly relative to the finger 74, the projections 76 first engage the slice frictionally, the resistance of which tends to bend the finger 74 downwardly and backwardly. The finger 74 then tends to bend somewhat along its entire curvature, and especially at the neck region 110, and it begins to straighten out, causing a downwardly directed force to be applied by the projections 76 against the slice 82. Since the presence of the slice 82 prevents the finger 74 from straightening substantially, the projections 76 dig into the upper surface of the slice like a barb, restricting, and preferably preventing any backward movement of the slice away from the finger 74.

Figure 17:
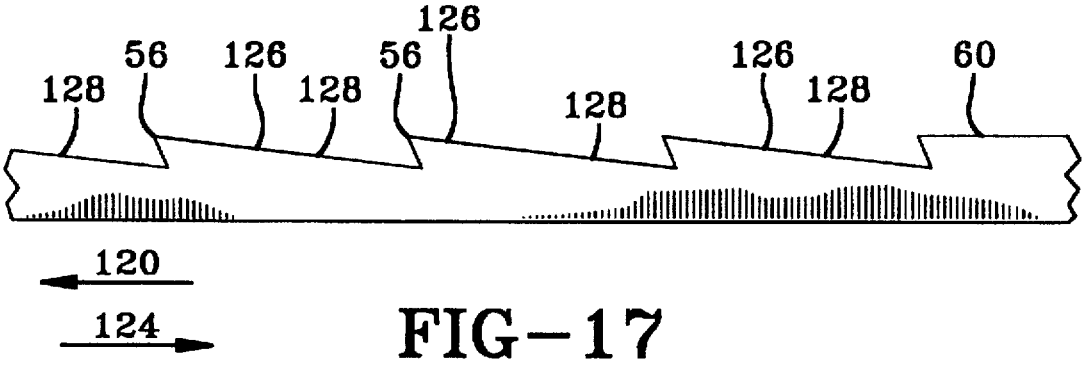
FIG. 17 is a side view illustrating the preferred stacking bed rod.

FIG. 17 illustrates the preferred shape of the projections 56 which are formed on the rods 60 of the stacking bed 52. In FIG. 17, the forward direction is indicated by the forward arrow 120 and the backward direction is indicated by the backward arrow 124. The rod 60 has a plurality of angled grooves 126 formed in its upper surface leaving a plurality of inclined plane projections 56. A slice resting on the projections 56 slides in the forward direction against the projections 56 with relatively little resistance, but in the backward direction with substantial resistance. This uni-directional resistance results from the barb effect of the projections 56, similar to the barb effect of the finger projections 76. As the rod 60 starts to move forwardly relative to the slice, the projections 56 tend to dig into the underside of the slice. This is especially so when the small, downwardly directed force is applied to the slice by the fingers 74. On the contrary, when the rod 60 moves in a backward direction relative to the stationary slice, and the slice is held in place by the fingers 74, the underside of the slice merely rubs against the sloping surfaces 128 which provide little resistance to sliding.

Therefore, the stacking bed 52 advances the slice 82 forwardly under at least one finger 74, and preferably multiple fingers 74, until the drive mechanism reaches its most forward extreme. The slight resistance to sliding under the fingers 74 does not move the slice 82 backwardly on the stacking bed 52 because the projections 56 prevent it. Once the most forward extreme position is reached, the drive mechanism stops the forward motion of the workpiece 32 and reverses. At this point, the stacking bed 52 is conveyed in a backward direction. As the stacking bed 52 moves backwardly as indicated by the arrow 83, the stacking bed 52 withdraws from beneath the slice 82. The slice is restricted from moving in the backward direction from where it was when the stacking bed 52 stopped, because of the barb effect of the gripping projections 76 extending from the lower surface of the fingers 74.

Figure 15:
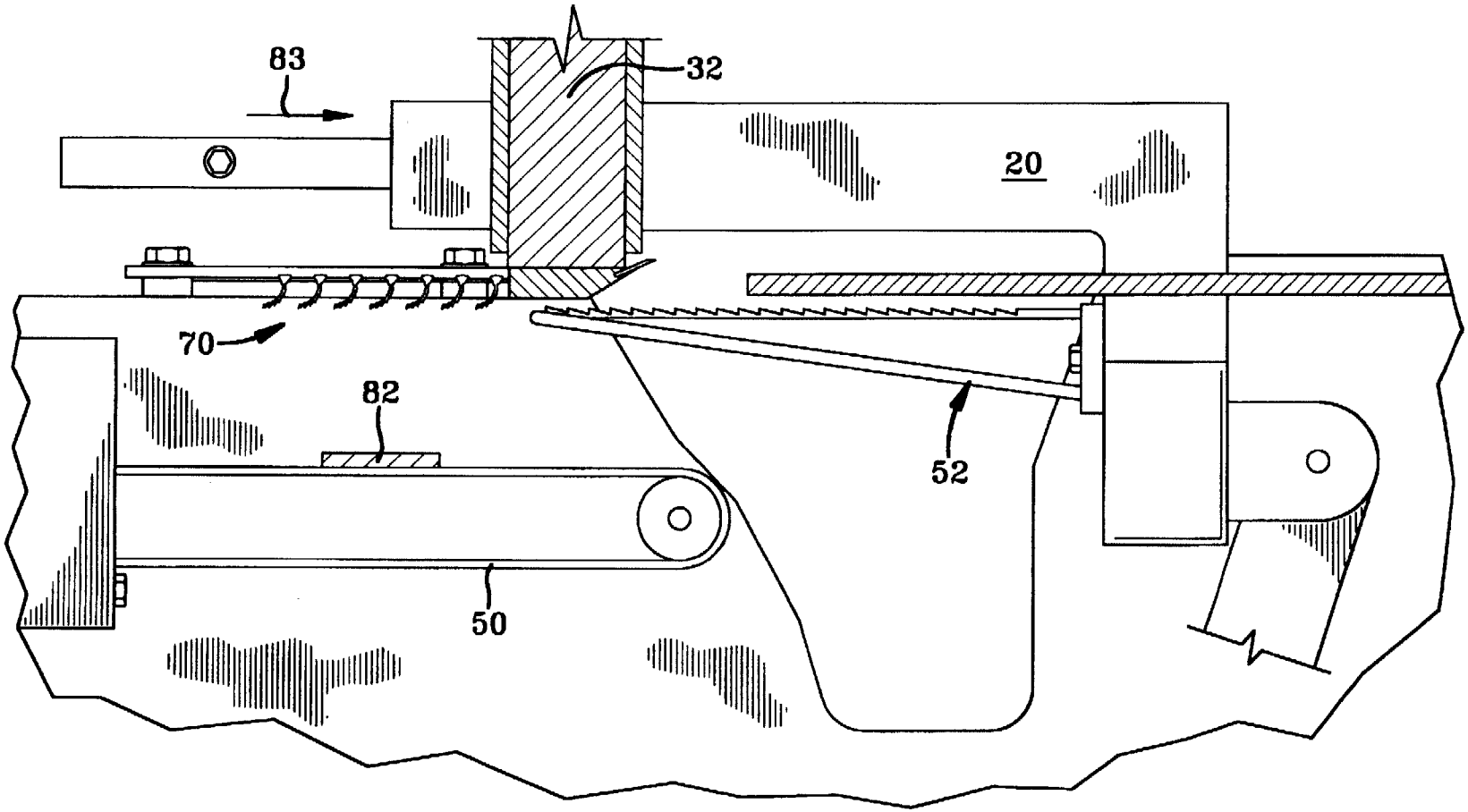
FIG. 15 is a side view in section illustrating the preferred embodiment.

Therefore, as the stacking bed 52 withdraws in a rearward direction from beneath the slice 82, the fingers 74 maintain the position of the slice 82 until the stacking bed 52 moves out from under the slice 82. At this time, the slice 82 falls downwardly onto the conveyor 50. This is the wiping step—wiping the slice from the withdrawing stacking bed 52. FIG. 15 shows the stacking bed 52 completely withdrawn from beneath the slice 82 and the slice 82 positioned on top of the conveyor 50.

The position at which the slice 82 lands on the conveyor 50 is the same as the position in three dimensional space to which every subsequent slice falls when it falls to the conveyor 50. This is so because the stacking bed 52 moves through the same reciprocation path each cycle it makes. Since there is no motion between the slice and the stacking bed 52 as they move forwardly, and since there is no relative motion between the wiper 70 and the slice when the stacking bed 52 is moving rearwardly, slices should fall from the same position during each cycle. Therefore, the slice's position upon landing on the conveyor 50 should be the same for each cycle.

In order to form a cylindrical stack having a plurality of circular slices, the conveyor 50, shown in FIG. 15, remains immobile during the period of time the plurality of slices is formed. Upon formation of a sufficient number of slices, the conveyor 50 is advanced some increment to provide a new surface upon which the next slice will land.

In order to form a shingled stack, a first slice lands on the conveyor 50, and the conveyor 50 is then advanced a distance equal to the desired spacing of the subsequent slice. This is repeated for the entire shingled stack. Once the stack of a sufficient number of slices has been formed, the conveyor 50 is advanced a preselected increment to again provide a new surface upon which the next slice will land.

The preferred slice receiving surface and wiper have been described, but it will become clear to one of ordinary skill in the art that alternative slice receiving surfaces and wipers could be made, embodying the same general principle as the preferred embodiment. This principle is that the resistance by the slice receiving surface against backward sliding should be greater than the resistance by the fingers to forward sliding. This is the case when the slice is conveyed forwardly by the stacking bed. Similarly, resistance by the fingers to backward sliding should be greater than the resistance by the slice receiving surface to forward sliding.

This can be illustrated by the following equations, where the first subscript is w for wiper or b for stacking bed slice receiving surface, the second subscript is f for forward direction or k for backward direction, and R is resistance to a slice sliding against the indicated surface in the indicated direction: $R_{bk}>R_{wf}$ and $R_{wk}>R_{bf}$. Therefore, the forward motion of the stacking bed should move the slice forward, unmoved by the small resistance of the wiper, and the wiper should keep the slice in place when the stacking bed withdraws from under it when it moves backwardly. Many structures will perform according to this principle.

An example of alternative stacking components are a wiper and/or a slice receiving surface made of one or more one-way ratcheting drums or discs. These can be made with or without the unidirectional slice gripping projections shown on the preferred embodiment. Alternatively, the wiper can be hinged weights with a smooth side and a rough, high-friction side. Either the wiper or the slice receiving surface can use retractable barbs. All of these embody the one-way resistance principle of the invention, and of course many other equivalent structures exist which could be used.

The wiper can be made of a plurality of thin fingers which extend downwardly between the rods 60 of the stacking bed 52, the tips never contacting the rods 60. These fingers are hinged at the top so that when a slice passes beneath them, they pivot up above it; then when it reverses direction the tips dig in since they can't pivot down below the slice receiving surface with the slice in the way.

Figure 18:
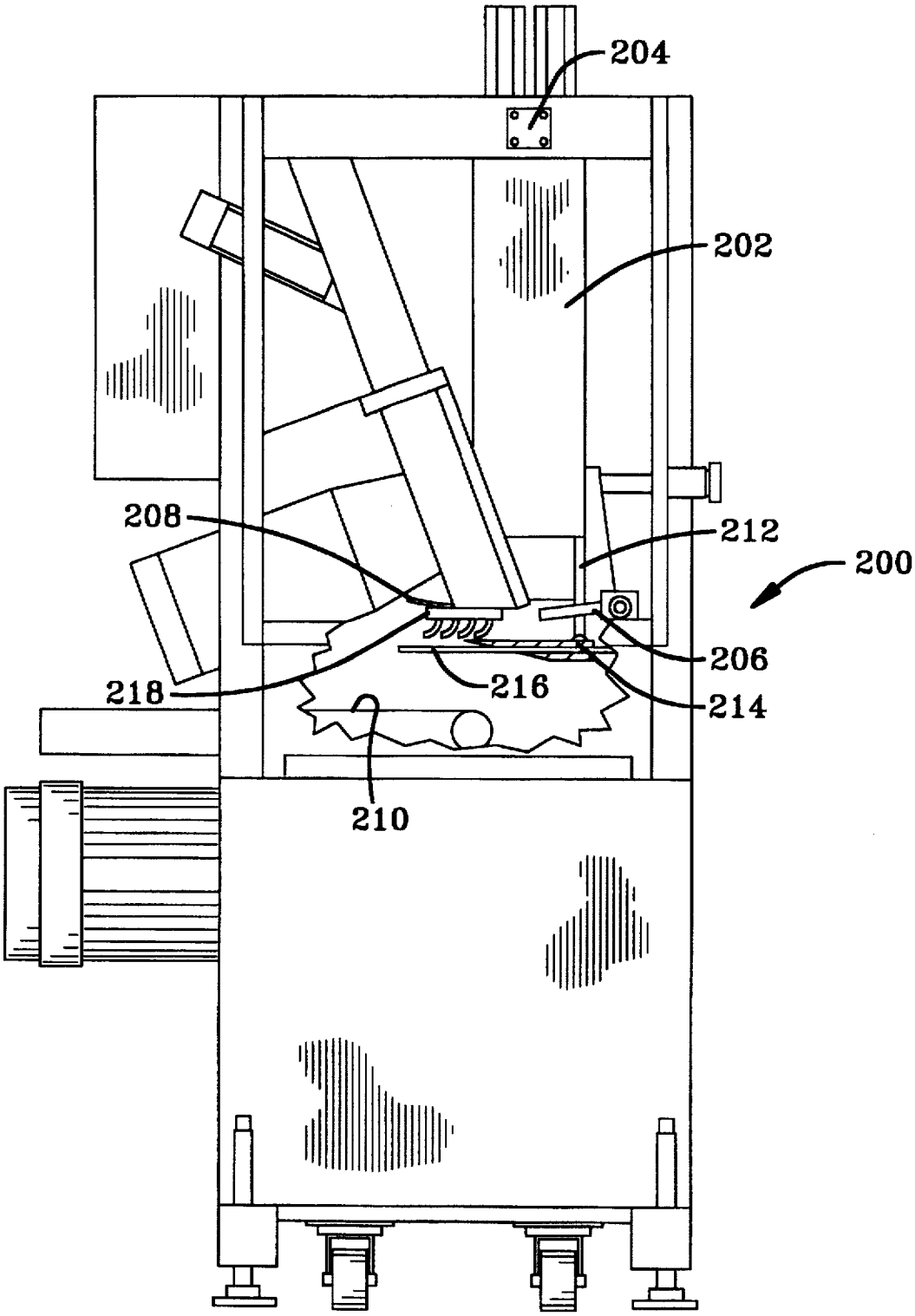
FIG. 18 is a side view in section illustrating an alternative embodiment of the present invention.

The present invention will also work on a slicing machine which operates according to the teachings of U.S. Pat. No. 4,436,012 to Hochanadel which is incorporated by reference. Hochanadel shows a pendulum-type slicing machine in which the workpiece is moved along an arcuate path which includes the slicing blade. This machine differs slightly from the slicing machine 10 shown in FIGS. 1 and 4, and the preferred attachment of the present invention to the Hochanadel pendulum-type machine is illustrated in FIG. 18. The slicing machine 200 comprises a carriage 202 which pivots about an upper axis 204. The carriage 202 reciprocates left to right in FIG. 18 over an infeed table 206 and an outfeed table 208 with a blade positioned between the two (not visible in FIG. 18). Slices are formed in a manner similar to the slicing machine 10 of FIGS. 1 and 4, and drop onto a conveyor 210. A longitudinally slidably mounted rod 212 extends downwardly from the carriage 202 and pivotably mounts to the stacking bed 214. The stacking bed 214 is slidingly mounted to a rail 216 on one side, and a second rail (which is not visible in FIG. 18) on its opposite side. The stacking bed 214 is driven along the rail 216 by the radially rigidly mounted rod 212 which propels the stacking bed 214 simultaneously with the carriage 202. A wiper 218 is positioned above the stacking bed 214 to cooperate with the stacking bed 214 as in the preferred embodiment.

In addition to the rigid attachment of the preferred stacking bed to the reciprocating carriage, and the pivoting attachment shown in FIG. 18, it is possible to separately drive the stacking bed simultaneously with the reciprocating carriage. In this case, it is necessary to have a separate drive link to drive the stacking bed along a path. This type of arrangement will be disadvantageous in that a separate drive means creates complexities involving timing and velocities, but a person of ordinary skill in the art, once apprised of the present invention by reading this description, could easily build such an apparatus. Additionally, for example, the carriage can actuate a switch at each opposite extreme position which reverses the motion of the stacking bed drive mechanism.

Figure 19:
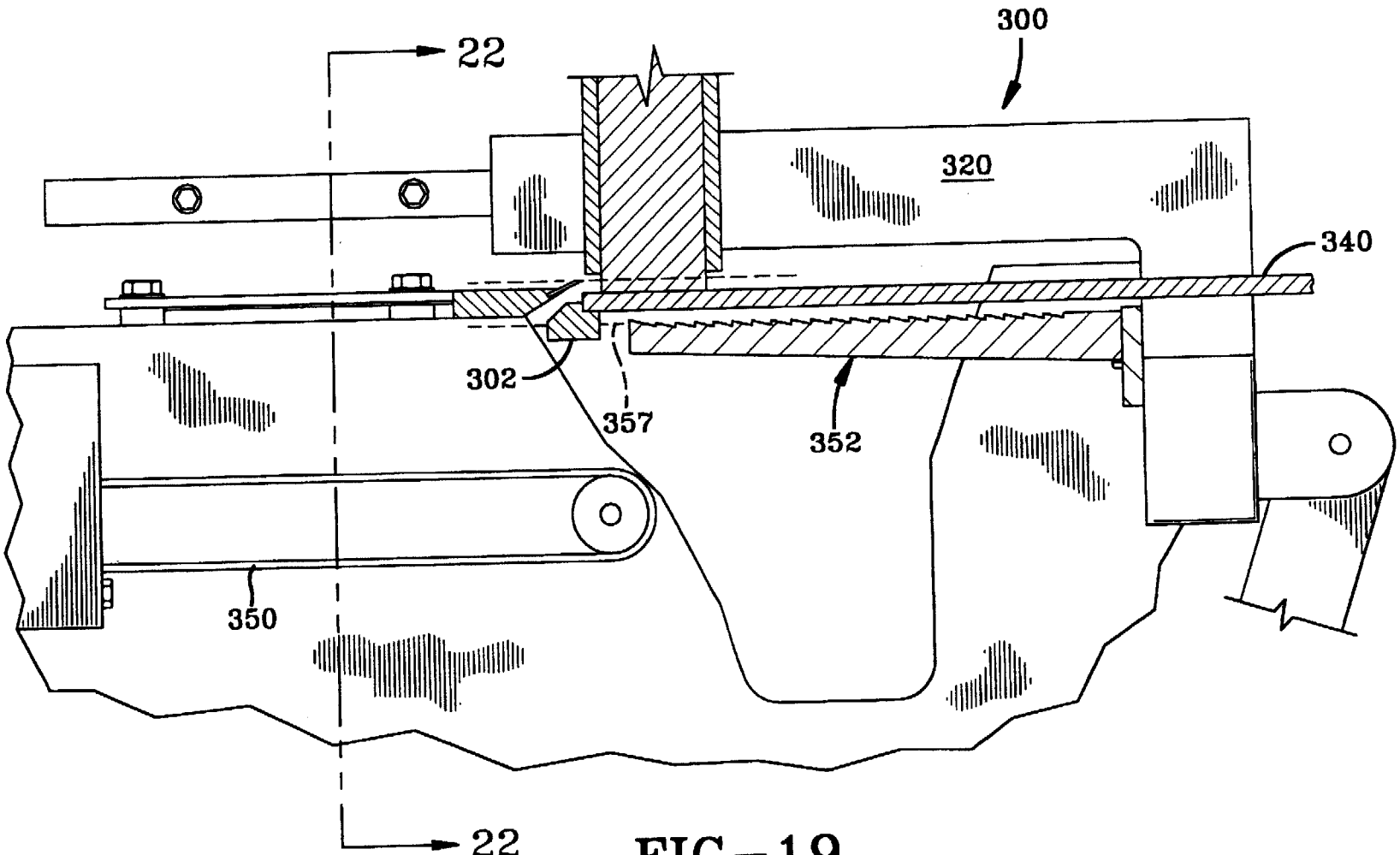
FIG. 19 is a side view in section illustrating an alternative embodiment of the present invention.

In FIG. 19 a machine 300, similar to the machine shown in FIGS. 10 to 15, is illustrated. A stacking bed 352 is mounted to a reciprocating side member 320 which is drivingly linked to a drive mechanism. A rake 302 is rigidly mounted to an infeed table 340. The rake 302 is positioned in the second path 357 (containing the slice receiving surface) and removes slices from the stacking bed 352.

Figure 20:
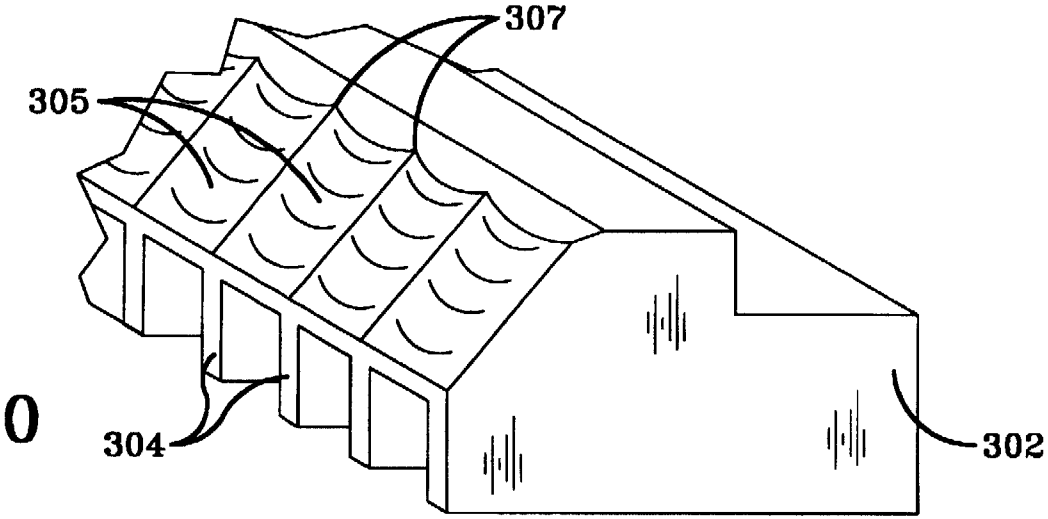
FIG. 20 is a view in perspective illustrating a preferred rake.

The rake 302 is shown in greater detail in FIG. 20. The rake 302 has downwardly extending tines, preferably elongated panels 304, which are mounted to the rake 302 at their upper, long edge. The recesses 305 and apexes 307 formed on the front face of the rake 302 provide resistance to lateral sliding of a slice against the rake 302.

Figure 21:
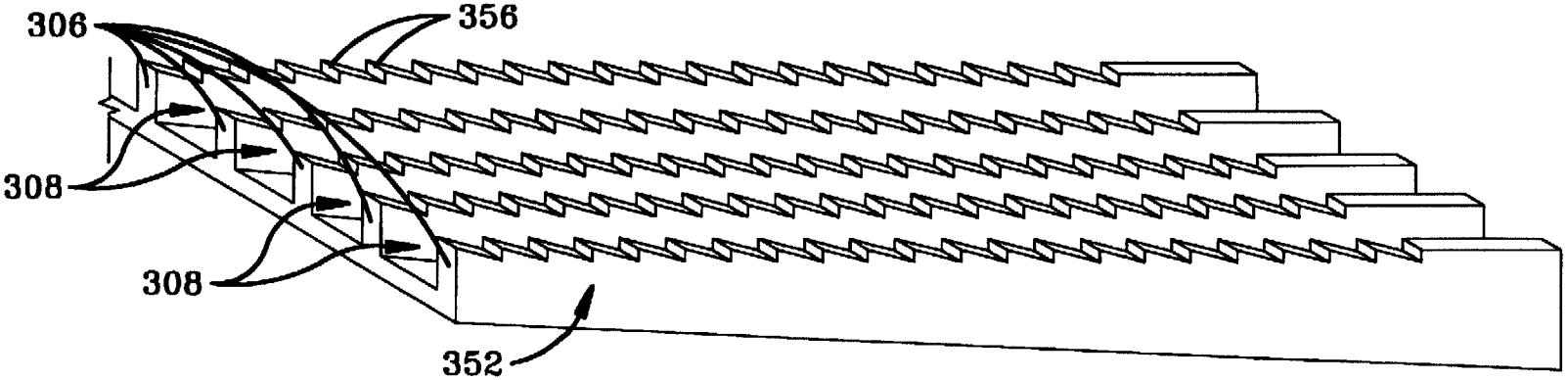
FIG. 21 is a view in perspective illustrating a preferred stacking bed for use in combination with the rake of FIG. 20.

The stacking bed 352 is shown in greater detail in FIG. 21, having upwardly extending ridges 306. The ridges have grooves 308 formed between them. Each ridge preferably has projections 356 formed on its upper edge, the tips of which form the slice receiving surface. The projections 356 are essentially identical in shape and dimension to the projections 56 described in relation to the stacking bed 52 of FIG. 7. The stacking bed 352 of FIG. 21 is preferably made of a low friction, rigid material, such as nylon or that material sold under the trademark DELRIN.

Figure 22:
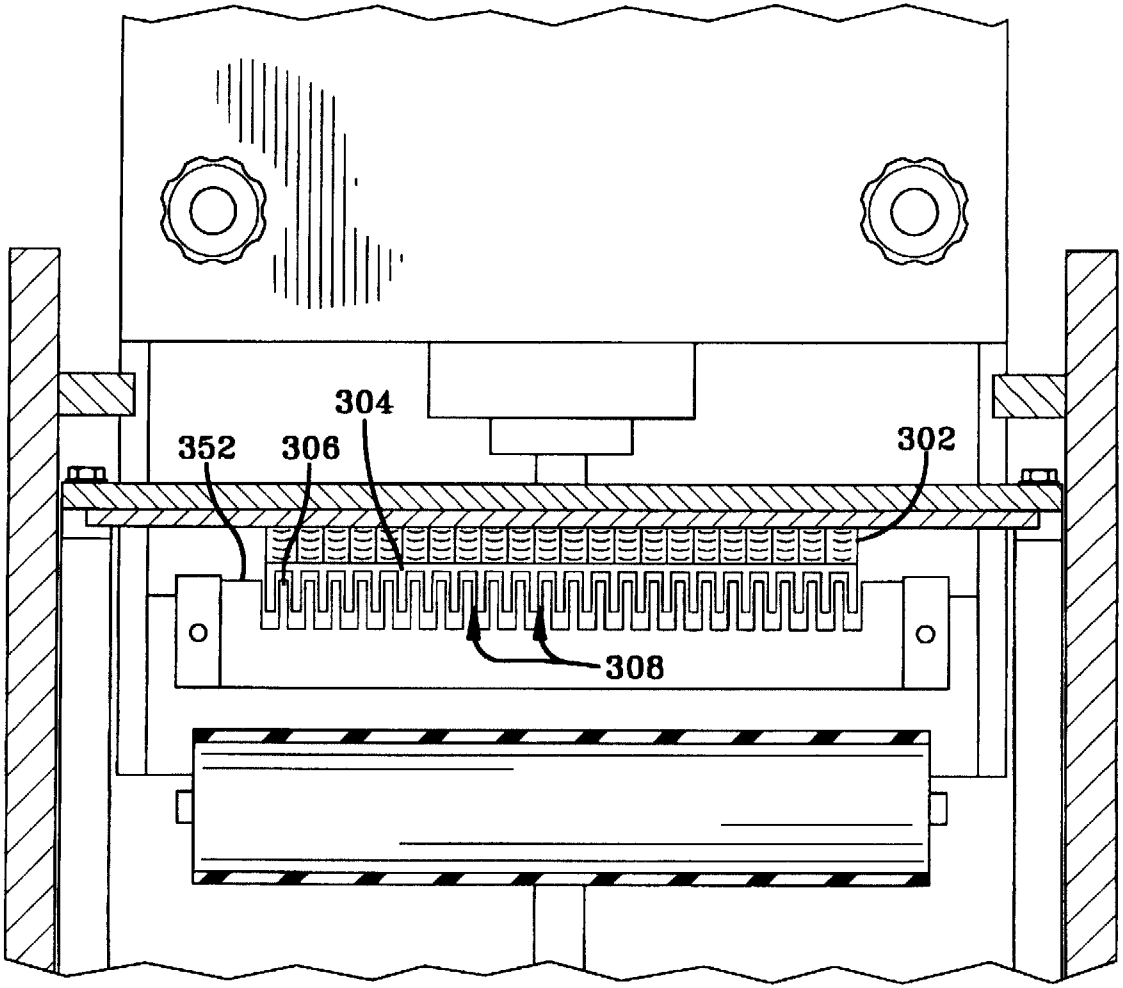
FIG. 22 is an end view in section illustrating the tines of the rake and the ridges of the stacking bed in their operable, cooperative positions.

FIG. 22 is an end view in section through the line 22—22 of FIG. 19. This view shows the rake 302 with its tines 304 extending downwardly into the grooves 308 between the ridges 306. The tines 304 preferably do not contact the ridges 306, since contact creates problems involving friction and wear. Of course it is possible that the ridges 306 and the tines 304 contact one another, but is preferred that they do not. The lower extremity of the tines 304 extends beneath the upper extremity of the ridges 306. This prevents a slice from passing between the rake and the stacking bed.

Figure 23:
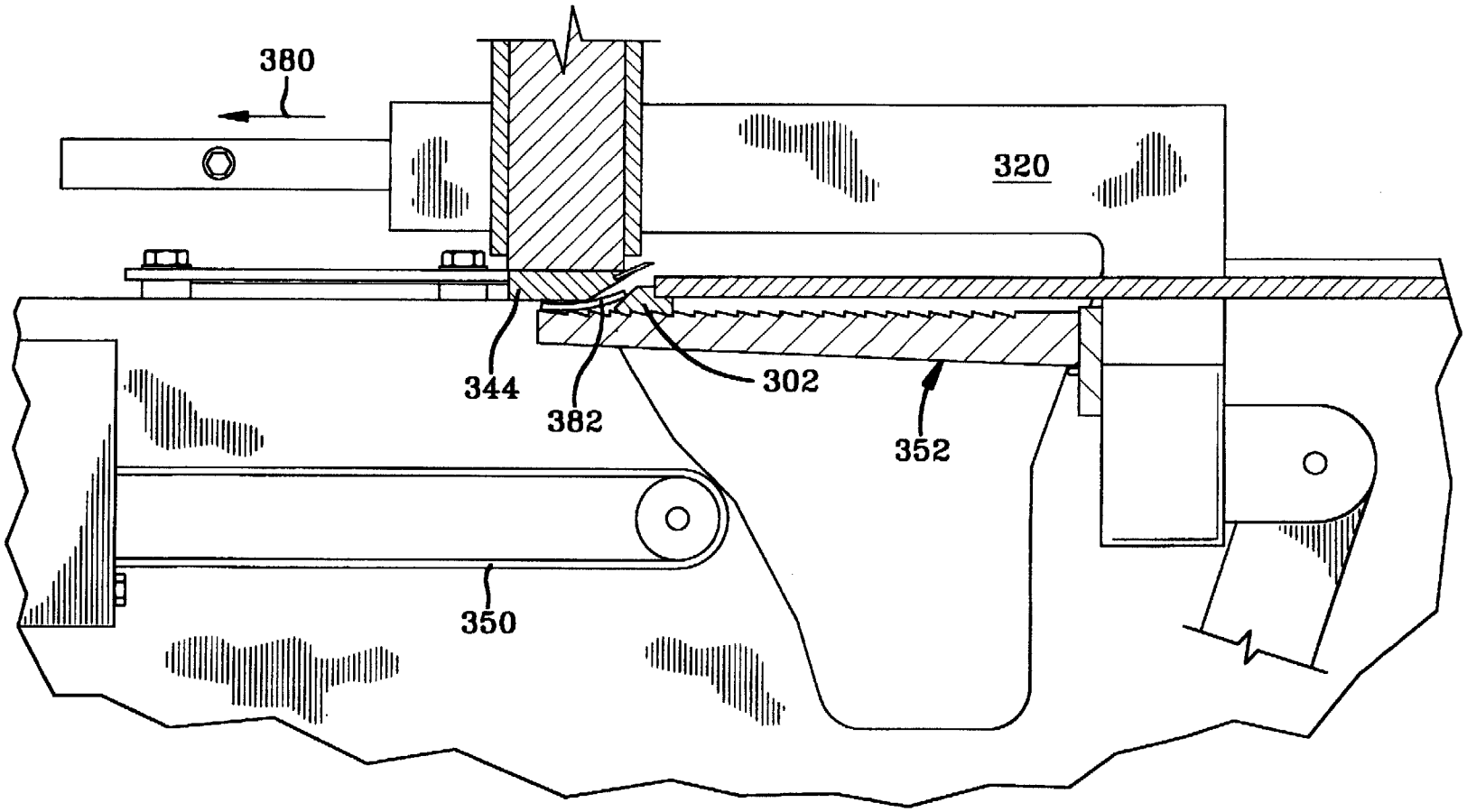
FIG. 23 is a side view in section illustrating an alternative embodiment of the present invention.

Referring now to FIG. 23, the side member 320 is displaced in a first, preferably forward direction (as indicated by the arrow 380) during the forming of a slice. The stacking bed 352 is also displaced forwardly. A slice 382 is formed in the same manner as is described above, and falls downwardly onto the slice receiving surface of the stacking bed 352, passing through a gap between the rake 302 and the blade supporting block 344. As the slice slides down the rake 302, the apexes 307 between the recesses 305 resist lateral sliding of the slice 382 which can arise due to lateral movement of the blade. The stacking bed 352 grips and carries the slice 382 in the direction 380 beyond the rake 302 due to the projections 357 providing high resistance to slippage of the slice 382 against the stacking bed 352 when the stacking bed 352 is driven in this direction. The invention will function if no projections are formed on the stacking bed 352, but the formation of projections 356 has been found to enhance gripping in one direction without increasing it in the opposite direction.

The side member 320 is next driven in the opposite, second direction and, when the stacking bed 352 is displaced a sufficient distance, the rightward edge of the slice 382 abuts against the leftward edge of the rake 302. Since the tines 304 of the rake 302 extend below the slice receiving surface 357, the rake 302 holds the slice 382 in the same position relative to the rake 302 while the stacking bed 352 continues to move. Therefore, as the stacking bed 352 moves rearwardly with the slice 382 abutted against the rake 302, the stacking bed 352 slides out from beneath the slice 382. The low resistance to slippage provided by the projections 357 when the stacking bed 352 is driven in this direction aids in displacing the slice 382 from the stacking bed 352.

Once the slice 382 is raked from the stacking bed 352 by the rake 302, it falls downwardly onto the conveyor 350. The conveyor 350 functions similarly to the conveyor 50 illustrated in FIG. 4. The conveyor 350 can be moved continuously throughout the slicing process or paused for predetermined time periods while slices are formed to permit stacking or shingling of slices.

Figure 24:
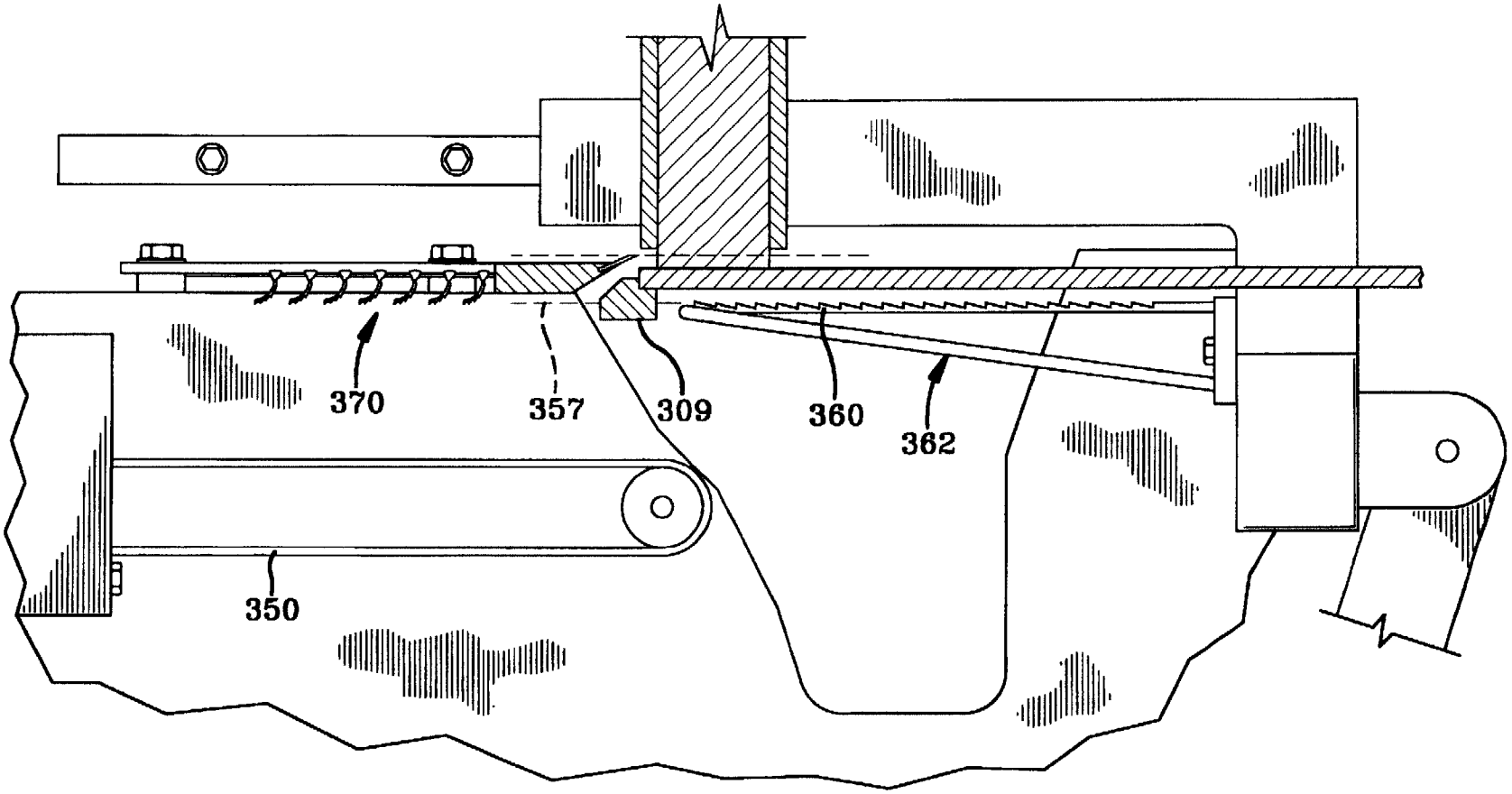
FIG. 24 is a side view in section illustrating an alternative embodiment of the present invention.

FIG. 24 shows the rake 309 used in combination with the wiper 370, which is similar to the wiper 70 described in FIGS. 10 to 15. The stacking bed 362 is similar to the stacking bed 52 shown in FIGS. 10 to 15, and the tines of the rake 309 extend downwardly between the rods 360. A support bar 62 extends across the free end of the cantilevered stacking bed 52 shown in FIG. 8, but no similar bar exists at the forward edge of the stacking bed 362. Since the rods 360 have open spaces between them, the tines of the rake 309 extend downwardly between the rods 360 as the stacking bed 362 is driven past the rake 309. In the embodiment of FIG. 24, the wiper 370 performs the primary slice removing function, and the rake 309 serves as a secondary slice removing structure, ensuring that the slices are removed from the stacking bed 362, and do not back up on the stacking bed 362. This shows the rake feature used with the wiper 370, which is an alternative to its preferred use without a wiper 370.

Figure 25:
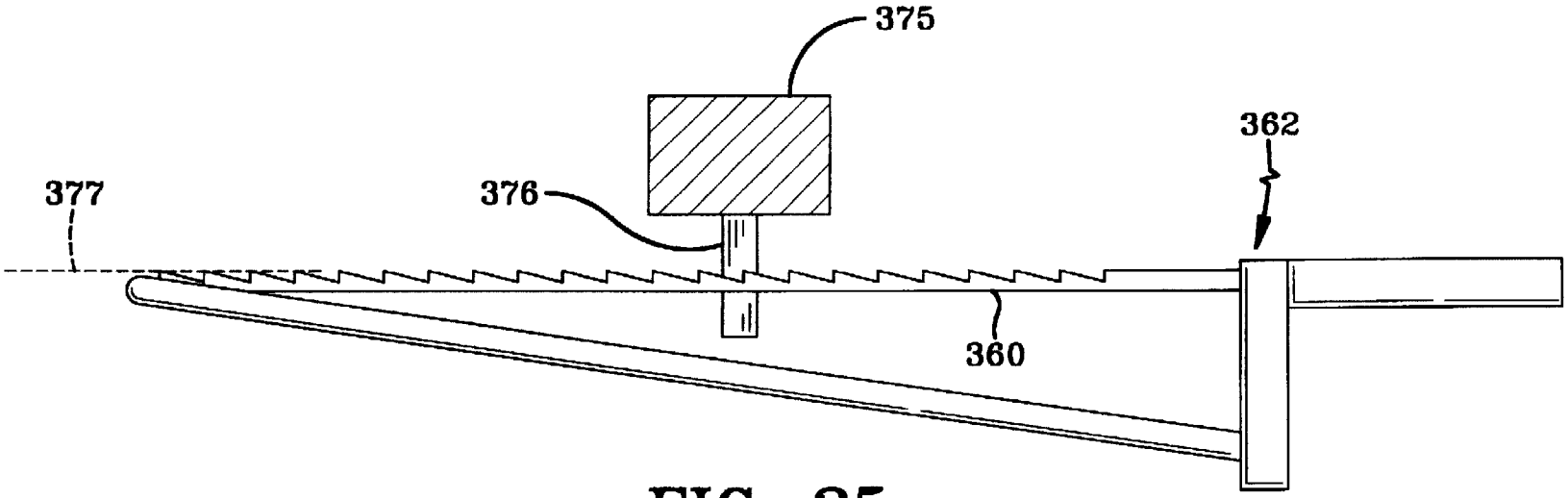
FIG. 25 is a side view illustrating an alternative rake.

The rake 375 shown in FIG. 25 can be used instead of the rake 309 shown in FIG. 24. The rake 375 has downwardly extending tines, preferably cylindrical fingers 376 which extend between the rods 360 of the stacking bed 362, partially beneath the slice receiving surface 377. The spaces between the rods 362 are grooves, although they have no floor.

Figure 26:
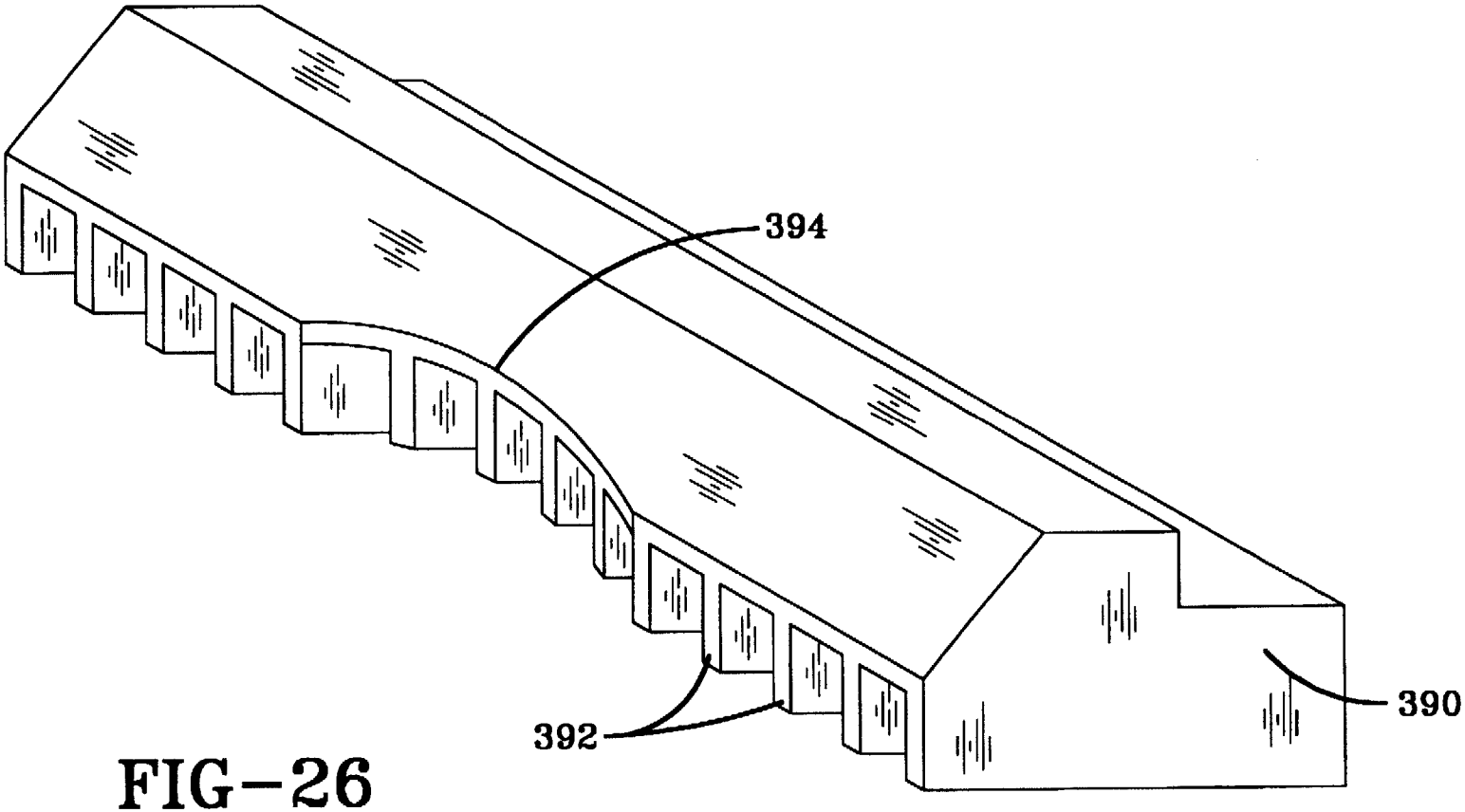
FIG. 26 is a view in perspective illustrating an alternative rake.

In FIG. 26, an alternative rake 390 is shown having similar downwardly extending tines 392 as the rake 302 described above. A slice shaped cavity 394 is formed in the leading edge of the rake 390. The cavity 394 is curved to match the shape of the edge of a slice which the rake 390 will rake from a stacking bed. The cavity 390 is positioned in the place on the stacking bed near where a slice will fall, and as the slice abuts against the rake 390, it will abut against the leading edge of the rake 390 near, and preferably in, the cavity 394. The slice slides into the cavity 394 as the rake 390 pushes it along, and the rake 390 holds the slice in place as the stacking bed slides from beneath the rake 390. The cavity 394 provides more precise alignment of a slice on the stacking bed, so that when the stacking bed slides from beneath the rake 390 each slice will fall to the same place on a conveyor beneath.

Figure 27:
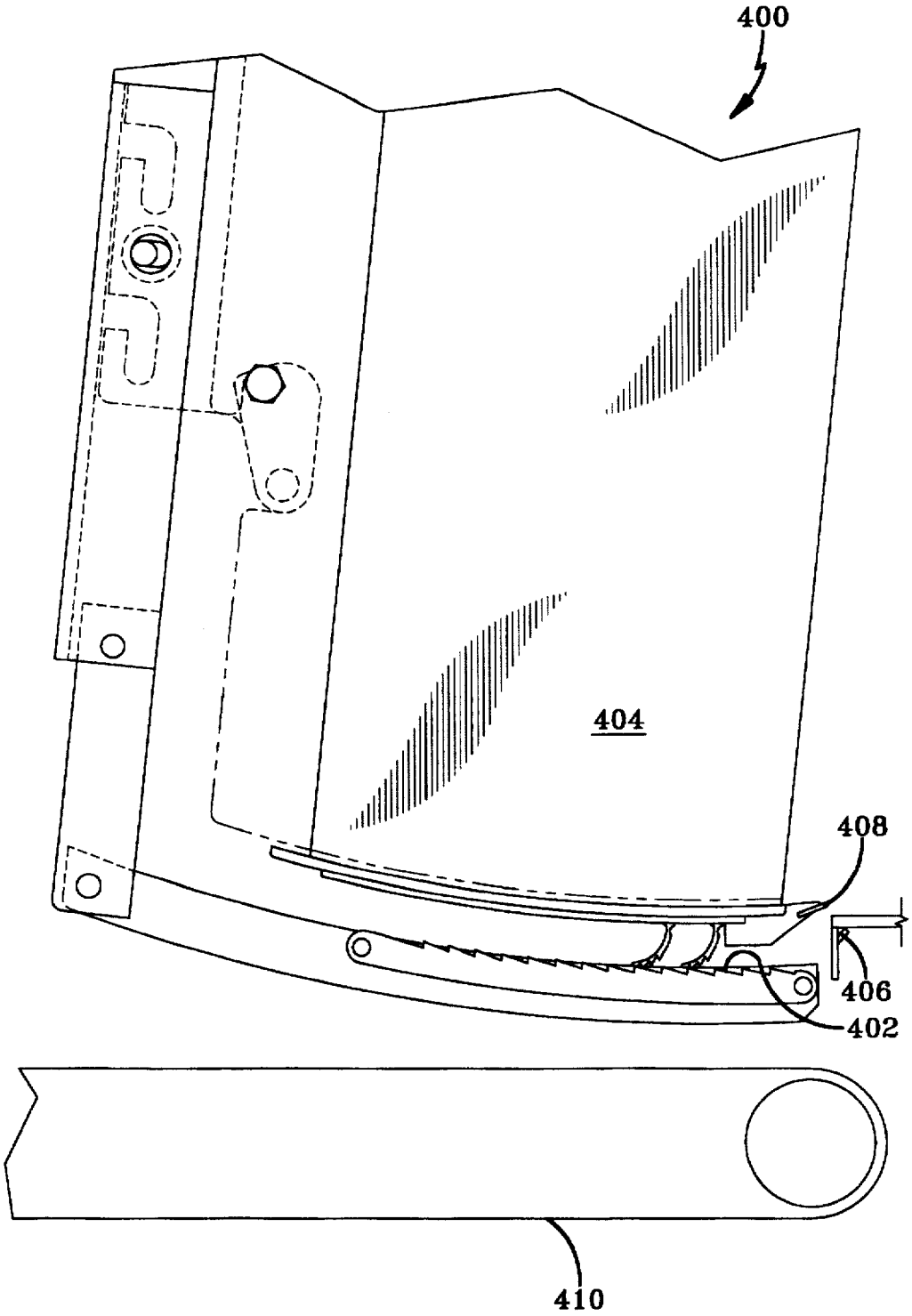
FIG. 27 is a side view in section illustrating an alternative embodiment of the present invention.

The present invention can be used on a machine similar to that shown in FIG. 18. One embodiment of the invention is shown in FIG. 27, used on a pendulum-type reciprocating slicer 400. A stacking bed 402 is mounted to the reciprocatable carriage 404. A rake 406 mounts rigidly to the frame of the machine 400 and the carriage 404 reciprocates past the rake 406. As a slice is formed, it passes through a gap between the blade 408 and the rake 406, falling onto the stacking bed 402. A slice is formed when the stacking bed travels in the leftward direction in the drawing of FIG. 27. Upon reversal of the motion of the stacking bed 402, the slice is conveyed on the stacking bed 402 toward the rake 406, abutting against the rake 406 at some point in its rightward travel. The slice is held in place by the rake 406 as the stacking bed 402 slides out from beneath it. The slice falls onto the conveyor 410 from the stacking bed 402.

The stacking bed 402 is drivingly linked to the carriage 404 to follow an arcuate path as shown in FIG. 27. Additionally, the stacking bed 402 could be driven along a linear path by a link to the carriage 404, as described for the embodiment of FIG. 18.

While certain preferred embodiments of the present invention have been disclosed in detail, it is to be understood that various modifications may be adopted without departing from the spirit of the invention or scope of the following claims.

We claim:

1. In a slicing machine having a reciprocatable, workpiece-retaining carriage drivingly connected to a motor for reciprocating a sliceable workpiece retained in the carriage along a first path, the slicing machine also having a cutter mounted along the first path for cutting through the workpiece when the carriage moves in a its reciprocating cycle in a first direction to form a falling slice having a selected thickness, an improved slice stacking apparatus comprising:

(a) a stacking bed having an upper, slice receiving surface for the falling slice to land upon and in which at least one groove is formed, the slice receiving surface drivingly connected to the motor and reciprocating in a predetermined, cooperating relationship with the carriage in the cycle through a second path substantially parallel to the first path and extending at least partially beneath the cutter; and (b) a stationary rake mounted in a fixed position above the second path, said rake including at least one tine extending downwardly into the second path, said at least one tine extending into said at least one groove during at least a portion of every reciprocation cycle of the slice receiving surface, for raking the slice from the slice receiving surface as the slice receiving surface moves beneath the stationary rake in a second, opposite direction from said first direction.

2. An apparatus in accordance with claim 1, further comprising multiple, substantially parallel grooves formed in the slice receiving surface, and multiple tines extending from the rake into the second path, the tines extending into the grooves.

3. An apparatus in accordance with claim 2, further comprising multiple ridges extending upwardly from between neighboring grooves.

4. An apparatus in accordance with claim 3, further comprising slice gripping projections formed on the ridges and configured to provide substantially more resistance to sliding against the ridges in a second direction than in the opposite, first direction.

5. An apparatus in accordance with claim 4, wherein each slice gripping projection has first and second opposite longitudinal ends connected by a planar, projection surface, each first end projecting upwardly from the stacking bed a greater distance than each second end, and each projection forming an inclined plane.

6. An apparatus in accordance with claim 3, wherein the tines are parallel, elongated panels mounted at a long edge to the rake, and the ridges are parallel, elongated panels mounted at a long edge to the stacking bed, the ridges extending upwardly in between the tines and the tines extending downwardly in between the ridges.

7. An apparatus in accordance with claim 3, wherein the tines are laterally spaced, downwardly extending fingers, the ridges are longitudinally oriented rods, the grooves are the spaces between the rods and the fingers extend downwardly into the grooves between the rods.

8. An apparatus in accordance with claim 1, further comprising a slice shaped cavity formed in the rake, for aligning the slice relative to the rake.

9. An apparatus in accordance with claim 1, further comprising a wiper extending downwardly into the second path toward the slice receiving surface, and spaced above the slice receiving surface no more than the slice thickness during at least another portion of the reciprocation of the slice receiving surface, for wiping the slice from the slice receiving surface.

10. An apparatus in accordance with claim 9, wherein the wiper is textured to provide substantially more resistance to the slice sliding against the wiper in the second direction than in the opposite, first direction.

11. In a slicing machine having a reciprocatable, workpiece-retaining carriage drivingly connected to a motor for reciprocating a sliceable workpiece retained in the carriage along a first path, the slicing machine also having a cutter mounted along the first path for cutting through the workpiece when the carriage moves in a reciprocating cycle in a first direction to form a falling slice having a selected thickness, an improved slice stacking apparatus comprising:

(a) a stacking bed having an upper, slice receiving surface for the falling slice to land upon, said slice receiving surface drivingly connected to the motor and reciprocating in a predetermined, cooperating relationship with the carriage through a second path substantially parallel to the first path and extending at least partially beneath the cutter; and (b) a stationary wiper mounted in a fixed position above the second path, extending downwardly into the second path toward the slice receiving surface, and spaced above the slice receiving surface no more than the slice thickness during a portion of the reciprocation of the slice receiving surface, for wiping the slice from the slice receiving surface as the slice receiving surface moves beneath the stationary wiper in a second, opposite direction from said first direction.

12. An apparatus in accordance with claim 11, wherein the stacking bed is mounted to the carriage for simultaneous movement of the stacking bed and the carriage.

13. An apparatus in accordance with claim 11, wherein the stacking bed is drivingly connected to the carriage for simultaneous movement of the stacking bed and the carriage.

14. An apparatus in accordance with claim 11, wherein the slice receiving surface is textured to provide substantially more resistance to the slice sliding against the slice receiving surface in the second direction than in the opposite, first direction.

15. An apparatus in accordance with claim 11, wherein the wiper is textured to provide substantially more resistance to the slice sliding against the wiper in the second direction than in the opposite, first direction.

16. An apparatus in accordance with claim 11, wherein slice gripping projections form the slice receiving surface.

17. An apparatus in accordance with claim 16, wherein each slice gripping projection has first and second opposite longitudinal ends connected by a planar projection surface, each first end projecting upwardly from the stacking bed a greater distance than each second end, and each projection forming an inclined plane.

18. An apparatus in accordance with claim 17, wherein the wiper comprises a plurality of fingers, each finger having a fingertip extending into the second path.

19. An apparatus in accordance with claim 18, wherein each finger is arcuately shaped and mounted near one finger edge to a panel, and each finger extends from a corresponding finger mount at the panel in the first direction and downwardly toward the slice receiving surface.

20. An apparatus in accordance with claim 19, wherein each fingertip has a plurality of slice gripping projections.

* * * * *